US006957022B2

(12) United States Patent
Hirai et al.

(10) Patent No.: US 6,957,022 B2
(45) Date of Patent: Oct. 18, 2005

(54) IMAGE FORMING APPARATUS

(75) Inventors: Masashi Hirai, Katano (JP); Kohichi Yamauchi, Yamatokoriyama (JP); Fumio Shimazu, Nara (JP); Hiroshi Tachiki, Yamatokoriyama (JP); Yuji Nakagawa, Soraku-gun (JP)

(73) Assignee: Sharp Kabushiki Kaisha, Osaka (JP)

( * ) Notice: Subject to any disclaimer, the term of this patent is extended or adjusted under 35 U.S.C. 154(b) by 64 days.

(21) Appl. No.: 10/769,491

(22) Filed: Jan. 29, 2004

(65) Prior Publication Data

US 2004/0184824 A1 Sep. 23, 2004

(30) Foreign Application Priority Data

Feb. 7, 2003 (JP) ..... P2003-031290
Feb. 21, 2003 (JP) ..... P2003-044571
Feb. 28, 2003 (JP) ..... P2003-054337

(51) Int. Cl.[7] ..... G03G 15/00
(52) U.S. Cl. ..... 399/21; 399/18
(58) Field of Search ..... 399/21, 18, 19, 399/16, 22; 101/211; 271/9.06, 259

(56) References Cited

U.S. PATENT DOCUMENTS 5,374,045 A * 12/1994 Milillo ..... 271/9.06
5,502,545 A * 3/1996 Tsuruoka ..... 399/21
5,652,942 A * 7/1997 Iseki et al. ..... 399/21
5,732,620 A * 3/1998 Christy et al. ..... 100/80
5,809,391 A * 9/1998 Fujita et al. ..... 399/396
6,011,936 A * 1/2000 Kaneko ..... 399/21
6,775,486 B2 * 8/2004 Matsuyama et al. ..... 399/21
6,876,820 B2 * 4/2005 Hirai et al. ..... 399/21

FOREIGN PATENT DOCUMENTS

| | | |
|---|---|---|
| JP | 62-264144 | 11/1987 |
| JP | 05-053405 | 3/1993 |
| JP | 07-281534 | 10/1995 |
| JP | 11-119490 | 4/1999 |

* cited by examiner

*Primary Examiner*—Anthony H. Nguyen
(74) *Attorney, Agent, or Firm*—Edwards & Angell, LLP; David G. Conlin; George W. Hartnell, III

(57) ABSTRACT

A plurality of photosensitive drums are disposed in a sheet transport direction so as to be in contact with a transfer belt and a transfer voltage for transferring toner images on the photosensitive drums onto a sheet transported by the transfer belt is applied thereto. A sensor for sensing a temperature or humidity in the working atmosphere of the image forming apparatus is provided; when a jam occurs, sheet transportation is ceased at a first stage to thereby enable the sheet in the jam to be removed; at a second stage subsequent thereto, transportation of the sheet is restarted; and the transfer voltage applied onto the transfer belt is controlled based on a measurement result of the sensor.

26 Claims, 30 Drawing Sheets

FIG.19

| ENVIRONMENT | L' | BEND (L' - L) | TRANSFER BIAS (kV) | ATTRACTION FORCE (Kg) | PEELABILITY | TRANSPORTABILITY | DIRTINESS | SETTING |
|---|---|---|---|---|---|---|---|---|
| NN | 100 | 0 | 0 | 0 | × | × | ○ | |
| | 100 | 0 | 0.5 | 0.1 | × | × | ○ | |
| | 100 | 0 | 2 | 0.5 | ○ | ○ | ○ | ◎ |
| | 100 | 0 | 3 | 0.7 | ○ | ○ | ○ | ○ |
| LL | 100 | 0 | 0 | 0 | × | × | ○ | |
| | 100 | 0 | 0.5 | 0.4 | ○ | ○ | ○ | ○ |
| | 100 | 0 | 2 | 1 | △ | ○ | ○ | |
| | 100 | 0 | 3 | 1.5 | × | ○ | ○ | |

FIG.20

| ENVIRONMENT | L' | BEND (L' - L) | APPLICATION RANGE | ATTRACTION FORCE (Kg) | PEELABILITY | TRANSPORTABILITY | SETTING |
|---|---|---|---|---|---|---|---|
| HH | 200 | 100 | ALL SURFACE | 0.6 | ○ | ○ | ○ |
| | 200 | 100 | 50 mm IN THE TAIL END SIDE | 0.2 | △ | △ | |
| NN | 200 | 100 | ALL SURFACE | 1 | △ | ○ | △ |
| | 200 | 100 | 50 mm IN THE TAIL END SIDE | 0.5 | ○ | ○ | ○ |
| LL | 200 | 100 | ALL SURFACE | 1.5 | × | ○ | |
| | 200 | 100 | 50 mm IN THE TAIL END SIDE | 0.8 | ○ | ○ | ○ |

FIG.21

| ENVIRONMENT | L' | BEND (L' - L) | ATTRACTED LENGTH (mm) | ATTRACTION FORCE (Kg) | PEELABILITY | TRANSPORTABILITY | DIRTINESS | SETTING |
|---|---|---|---|---|---|---|---|---|
| NN | 100 | 0 | 320 | 2 | × | ○ | ◎ | |
| | 200 | 100 | 220 | 1 | ○ | ○ | ○ | ○ |
| | 250 | 150 | 170 | 0.5 | ○ | ○ | × | |
| LL | 100 | 0 | 320 | 2.5 | × | ○ | ◎ | |
| | 200 | 100 | 220 | 1.5 | × | ○ | ◎ | |
| | 250 | 150 | 170 | 1 | ○ | ○ | ○ | ○ |

FIG.26

| ENVIRONMENT | L' | BEND (L' - L) | ATTRACTED LENGTH (mm) | ATTRACTION FORCE (Kg) | PEELABILITY | TRANSPORTABILITY | DIRTINESS | SETTING |
|---|---|---|---|---|---|---|---|---|
| NN | 100 | 0 | 320 | 2 | × | ○ | ◎ | |
| | 200 | 100 | 220 | 1 | ○ | ○ | ○ | ○ |
| | 250 | 150 | 170 | 0.5 | ○ | ○ | × | |
| LL | 100 | 0 | 320 | 2.5 | × | ○ | ◎ | |
| | 200 | 100 | 220 | 1.5 | × | ○ | ◎ | |
| | 250 | 150 | 170 | 1 | ○ | ○ | ○ | ○ |

IMAGE FORMING APPARATUS

CROSS REFERENCE

This Nonprovisional application claims priority under 35 U.S.C. § 119(a) on Patent Application Nos. 2003-031290, 2003-044571, and 2003-054337, respectively filed in Japan on Feb. 7, 21, and 28, 2003, the entire contents of which are hereby incorporated by reference.

BACKGROUND OF THE INVENTION

The present invention relates to an image forming apparatus such as a copy machine, a printer, a facsimile and the like, in which various kinds of images are formed on a sheet recording medium, and particularly, to a jam processing technique when an anomaly in transportation (a jam) of a sheet recording medium occurs.

There has been available image forming apparatuses each forming an image in a procedure in which a toner image formed on an image carrier is transferred onto a sheet recording medium on a transfer carrier by electrostatic attraction and thereafter, the toner image is fixed on the sheet recording medium in a fixing device. Of such image forming apparatuses, especially in a tandem type image forming apparatus in which plural image forming stations each including an image carrier and an image forming process means placed therearound are disposed along a direction in which a sheet recording medium is transported, a single transfer carrier is formed opposite the image forming stations and therefore, the transfer carrier is eventually long.

Therefore, in a case where a jam occurs during transportation of sheet recording media being continuously fed, which leads to an emergency shutdown of an image forming apparatus, a sheet recording medium stops between an image carrier and a transfer carrier in more of cases. Especially in a case where a jam occurs in a fixing section, the operation has to be urgently shutdown. In such a case, a possibility is high that a subsequent sheet recording medium stays stopping between an image carrier and the transfer carrier.

In such a case where a sheet recording medium stays unmoving between an image carrier and the transfer carrier, it is difficult to take out the sheet recording medium, left unmoved, by pinching it between fingers since it is firmly attracted to the transfer carrier by static electricity and since the image carrier and the transfer carrier are in contact with each other. Therefore, for example, proposals have been made on a paper transport device or a non-peelable paper processing device in which if a jam occurs, a jam processing is performed in a way such that the transfer carrier is moved in a direction opposite a moving direction in copying operation to thereby return the sheet recording medium to a position where the sheet recording medium can be taken out with ease (see, for example, JP-A Nos. S62-264144 and H07-281534).

A proposal has been made on an image forming apparatus in which in a case where a jam of a sheet recording medium occurs, only a fixing section is caused to be out of operation and the other sections are continued to operate for a predetermined time, to transport the sheet recording medium to before the fixing section and to thereby facilitate a jam processing (see, for example, JP-A No. H05-053405 paragraph [0013] and [0016]).

A proposal has been made on a image forming apparatus in which in a case where a jam occurs and a sheet recording medium is transported to before a fixing section, a transfer voltage (a transfer bias) applied to the sheet recording medium with a transfer carrier is disconnected to alleviate an attraction force between the sheet recording medium and the transfer carrier by some amount and to thereby facilitate a jam processing (see, for example, JP-A No. H11-119490 paragraph [0055] and [0066]).

However, it is difficult to visually find a sheet recording medium present between a transfer carrier and an image carrier and it is common not to install a means for detecting a sheet recording medium present on the transfer carrier in most of image forming apparatuses currently available. Hence, when a jam occurs, it is difficult for an image forming apparatus itself or for a user to determine whether or not a sheet recording medium is in a state being left firmly attracted to the transfer carrier.

Therefore, if a transfer carrier is always moved back when a jam occurs despite a high possibility of the absence of a sheet recording medium on the transfer carrier as described in JP-A Nos. S62-264144 and H07-281534, a wasteful time is forcibly consumed in some case, leading to an issue of being uneconomical. In a case where a detector detecting a sheet recording medium present on a transfer carrier is installed, problems arise that an image forming section is large in size and that increase occurs in manufacturing cost or assembling cost.

In a case of JP-A No. H05-053405, if a jam of a sheet recording medium occurs, only a fixing section is caused to be out of operation and the other sections are continued to operate for a predetermined time, to transport the sheet recording medium to before the fixing section and to thereby facilitate a jam processing. In JP-A No. H11-119490, it is disclosed that in a case where a jam occurs, application of a transfer voltage (a transfer bias) to the sheet recording medium through a transfer carrier is ceased when a sheet recording medium is transported to before a fixing section to thereby alleviate an attraction force between the sheet recording medium and the transfer carrier by some amount and to thereby facilitate a jam processing.

An attraction force between a transfer carrier and a sheet recording medium depends not only on a transfer bias but also greatly on a contact pressure with a charged image carrier; therefore, only an operation to cease application of a transfer bias, in a case, does not sufficiently reduce an attraction force of the sheet recording medium to a transfer carrier.

An attraction force of a sheet recording medium is altered greatly by an environmental condition. Therefore, such an alteration, in turn, alters a degree of difficulty in operation of peeling-off a sheet recording medium from a transfer medium in a jam processing. If an attraction force of the sheet recording medium is low, a failure in transportation occurs, while if the force is high, the sheet recording medium is difficult in being peeled off.

SUMMARY OF THE INVENTION

It is an object of the present invention to provide an image forming apparatus capable of performing a jam processing operation with ease regardless of an environmental condition when a jam of a sheet recording medium occurs in operation of an image forming process.

It is another object of the present invention to provide an image forming apparatus capable of not making dirty a space inside the apparatus when a jam of a sheet recording medium occurs in operation of an image forming process.

The present invention has a below described construction in order to solve the above problems.

The present invention is directed to an image forming apparatus including:

a plurality of image carriers for carrying toner images, thereon, formed by an image forming process in operation thereof, the plurality of image carriers being disposed along a sheet transport direction;

a transfer carrier for transporting a sheet recording medium attracting the sheet recording medium thereon to transfer the toner images carried on the plurality of image carriers onto the sheet recording medium;

a transfer voltage applying section for applying a transfer voltage to the sheet recording medium transported by the transfer carrier;

a fixing device for fixing a toner image on the sheet recording medium transported by the transfer carrier, the fixing device being installed so as to be capable of moving toward outside of a side surface of the body of the image forming apparatus;

a jam processing control section for detecting occurrence of a jam of the sheet recording medium in operation of the image forming process to process the sheet recording medium in the jam; and a sensor for measuring an environmental condition of a temperature or humidity in the working atmosphere thereof, wherein the jam processing control section, when detecting occurrence of the jam, ceases transportation of the sheet recording medium in the jam by the transfer carrier as a first stage to make it possible to remove the sheet recording medium in the jam, and, if a second sheet recording medium in transit when the jam occurs is detected by the transfer carrier, advances to a second stage and restarts transportation of said second sheet recording medium in transit using said transfer carrier to transport the second sheet recording medium to the fixing device and to stop it there, and the transfer voltage applying section, when the jam processing control section is at the second stage, controls a transfer voltage to be applied to the second sheet recording medium based on a measurement result of the sensor when the jam processing control section is at the same second stage.

In an image forming apparatus such as a copy machine, a printer, a facsimile or the like, a sheet recording medium is transported between an image carrier and a transfer carrier being firmly attracted on the transfer carrier. An attraction force here increases in proportion to an area of a sheet recording medium in which to be firmly attracted to the transfer carrier. If an attraction force is stronger, difficulty is encountered in taking out a sheet recording medium staying stagnant inside the apparatus when a jam occurs.

Therefore, with a smaller attraction force, it is easier to take out a sheet recording medium stagnant within the apparatus. An attraction force between a sheet recording medium and a transfer carrier is greatly affected by a transfer voltage (a transfer bias) and charging of an image carrier caused by the transfer bias.

Since the attraction force is an electrostatic force, it greatly alters depending on an environmental condition such as a temperature or a humidity (especially a humidity). Hence, if the attraction force is rendered excessively smaller, a sheet recording medium cannot be transported. To the contrary, if the attraction force is increased excessive larger, a paper sheet as the sheet recording medium become hard to be peeled off.

Therefore, at the first stage immediately after occurrence of a jam is detected, it is enabled to remove a sheet recording medium in the jam and furthermore, at the second stage subsequent thereto, the jam processing control section restarts transportation of the sheet recording medium and controls a transfer voltage so as to be adapted for an environmental condition, that is based on a measurement result of the sensor detecting an environmental condition of a temperature or humidity in the working atmosphere thereof. By doing so, the sheet recording medium on a transport path (on the transfer carrier) which cannot be removed at the first stage can be surely transported with a proper attraction force to be eventually removed.

Since a developing agent (a toner) remains on the image carriers when a jam occurs and the apparatus is rendered out of operation, there arises a chance of a great bend of the sheet recording medium on the transport path due to a lengthy distance thereof if the sheet recording medium is tried to be transported at the second stage as described above. In such a case, an unfixed toner on the bent portion makes dirty members in the peripheral region of the transport path with a high possibility.

Therefore, at the first stage immediately after occurrence of the jam is detected, it is made possible to remove a sheet recording medium in the jam and at the second stage subsequent thereto, the jam processing control section restarts transportation of the sheet recording medium and controls a transport length of the sheet recording medium in transit so as to be adapted for an environmental condition, that is based on a measurement result of the sensor detecting an environmental condition of a temperature or humidity in the working atmosphere thereof.

To be concrete, for example, the jam processing control section sets such that a transport distance of the sheet recording medium in transit is shorter at a higher humidity than at a lower humidity.

A force to be required for peeling a sheet recording medium in transit of f from the transfer carrier differs depending on a size, larger or smaller, of the sheet recording medium. Therefore, if it is controlled so that at the second stage, a sheet recording medium long in size is sufficiently transported, a sheet recording medium short in size is excessively transported and a great bend is generated on the transport path to thereby cause an unfixed toner on the bent portion to attach onto members in the peripheral region of the transport path and to make them dirty with a high possibility. If it is controlled so that at the second stage, a sheet recording medium short in size is sufficiently transported, a sheet recording medium long in size cannot be sufficiently transported, in some case of which a possibility arises that the whole of the sheet recording medium long in size cannot be removed.

Therefore, the jam processing control section, when being at the second stage, controls a transport distance of a sheet recording medium in transit depending on a size thereof.

To be concrete, the jam processing control section sets such that a transport distance of a sheet recording medium in transit is shorter when a size of the sheet recording medium is smaller than when a size of the sheet recording medium is larger.

BRIEF DESCRIPTION OF THE DRAWINGS

FIG. 19 is a table showing results of experiments on a relationship between a transfer voltage and easiness of jam processing;

FIG. 20 is a table showing results of experiments on a relationship between a transfer voltage application range (length) and easiness of jam processing;

FIG. 21 is a table showing results of experiments on a relationship between a sheet transport distance and easiness of jam processing;

FIG. 26 is a table showing results of experiments on a relationship between a sheet transport distance and easiness of jam processing;

DETAILED DESCRIPTION OF THE INVENTION

Detailed description will be given of an image forming apparatus related to an embodiment of the present invention below with reference to the accompanying drawings.

<Image Forming Apparatus>

Figure 1:
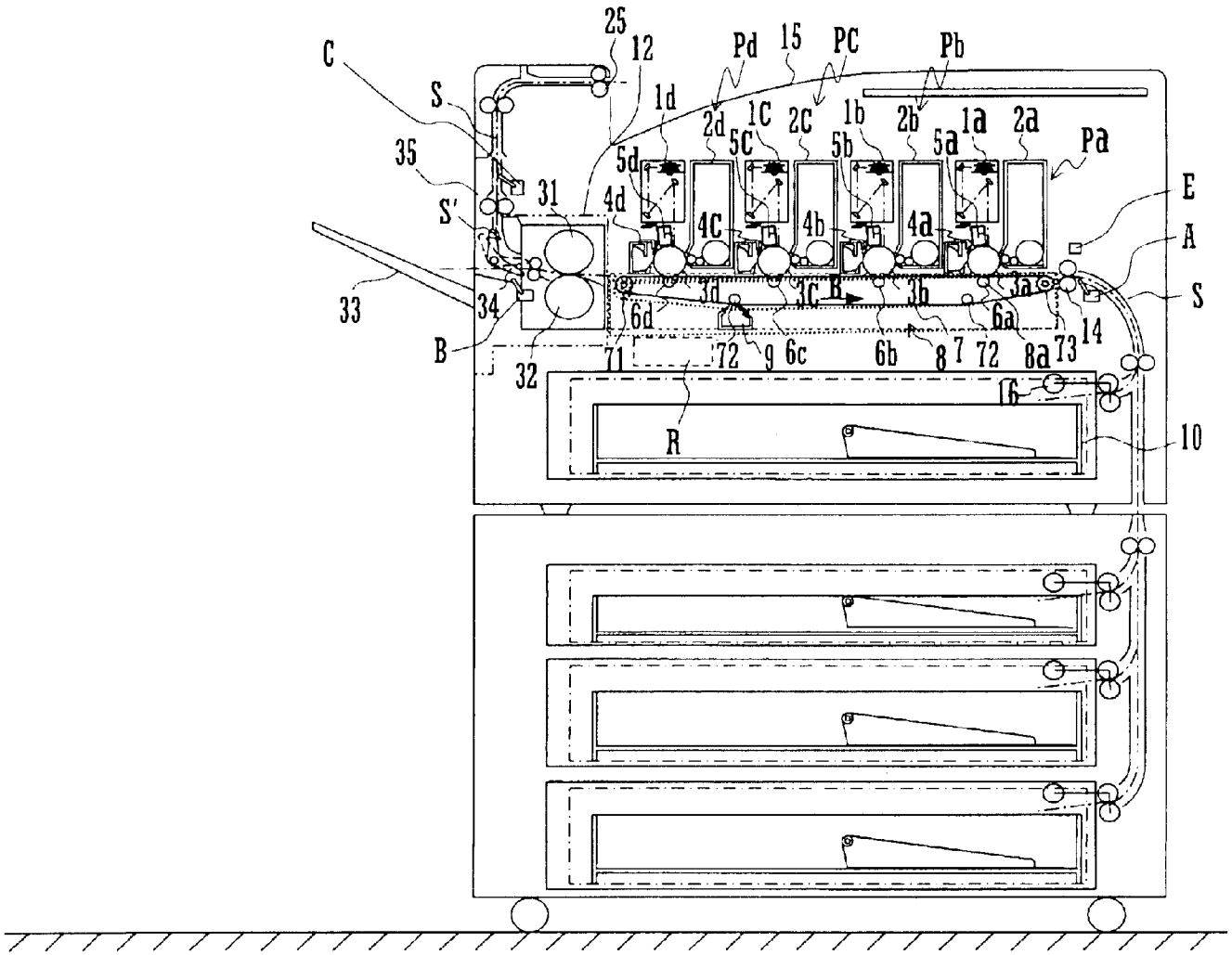
FIG. 1 is a configuration of a main section of an image forming apparatus related to an embodiment of the present invention.

FIG. 1 shows a configuration of an image forming apparatus.

The image forming apparatus forms an image in multiple colors or a single color on a predetermined sheet recording medium (hereinafter referred to as sheet) according to image data transmitted from outside and includes: exposure units 1; developers 2; photosensitive drums (image carriers) 3; chargers 5; cleaner units 4; a transfer transport belt unit 8; a fixing unit 12; a paper transport path S; paper feed trays 10; a paper discharge tray 15; and the like.

Image data handled in the image forming apparatus corresponds to a color image using colors of black (K), cyan (C), magenta (M) and yellow (Y). Four image stations Pa (black), Pb (cyan), Pc (magenta) and Pd (yellow) are constituted of the exposure units 1 (1*a*, 1*b*, 1*c* and 1*d*), the developers 2 (2*a*, 2*b*, 2*c* and 2*d*), the photosensitive drum 3 (3*a*, 3*b*, 3*c* and 3*d*), the chargers 5 (5*a*, 5*b*, 5*c* and 5*d*), and the cleaner units 4 (4*a*, 4*b*, 4*c* and 4*d*), respectively, and latent images corresponding to colors are formed in the respective image stations.

The photosensitive drums 3 are set in almost the center of the image forming apparatus.

The chargers 5 each are charging means for charging a surface of a corresponding photosensitive drum 3 uniformly at a predetermined potential. Employed as the charging means each are a charger as shown in the figure in addition to a contact type roller charger or a contact type brush charger.

Of the photosensitive drums 3, the photosensitive drum 3*a* is disposed in the most upstream side in the direction of sheet transportation.

The exposure units 1 each are a laser scanning unit (LSU) equipped with, for example, a LED write head having a light emitting elements arranged in an array, a laser illuminating section and a reflective mirror depicted in the figure. A photosensitive drum 3 charged with a charger 5 is exposed according to image data by an exposure unit 1 and an electrostatic latent image corresponding to the image data is formed on the surface thereof.

A developer 2 visualizes an electrostatic latent image formed on a photosensitive drum 3 with a toner (in one of colors K, C, M and Y). A cleaner unit 4 removes and recovers the toner remaining on the surface of a photosensitive drum after development and image transfer.

The transfer transport unit 8 placed below the photosensitive drums 3 includes: a transfer belt 7, a transfer belt driving roller 71, a transfer belt tension roller 73, plural transfer belt-driven rollers 72 and 73, transfer rollers 6 (6*a*, 6*b*, 6*c* and 6*d*) and a transfer belt cleaning unit 9. The transfer belt 7 spans with tension over the transfer belt driving roller 71, the transfer belt-driven rollers 72 and 74 and the transfer belt tension roller 73 and is rotation driven in a direction of an arrow mark B.

The transfer rollers 6 are rotatably supported on respective shafts in a housing inside the transfer transport unit 8 and spans the transfer belt 7 with tension across the transfer belt driving roller 71 and the transfer belt tension roller 73 under cooperation of the transfer belt-driven rollers 72 and 74. The transfer rollers 6 transfers toner images on the photosensitive drums 3 onto a sheet firmly attracted on the transfer belt 7.

The transfer belt 7 is fabricated using a film of a thickness of the order of 100 to 150 $\mu$m in an endless state and set in a way so as to be movable apart from or into contact with the photosensitive drums 3. The transfer belt 7, in a multicollor mode (see FIG. 9) in which image formation is performed in contact with all of the photosensitive drums 3, works such that toner images in colors formed on the respective photosensitive drums 3 are sequentially superimposed on one on another to thereby form a color toner image (multicolor image).

On the other hand, in a single color mode in which the transfer belt 7 is brought into contact with only the photosensitive drum 3*a* while the other photosensitive drums 3*b*, 3*c* and 3*d* are spaced apart from the transfer belt 7 (see FIG. 10), the transfer belt works such that a toner image in black (monochromatic toner image) is transferred onto a sheet to form a black-and-white image.

Figure 9:
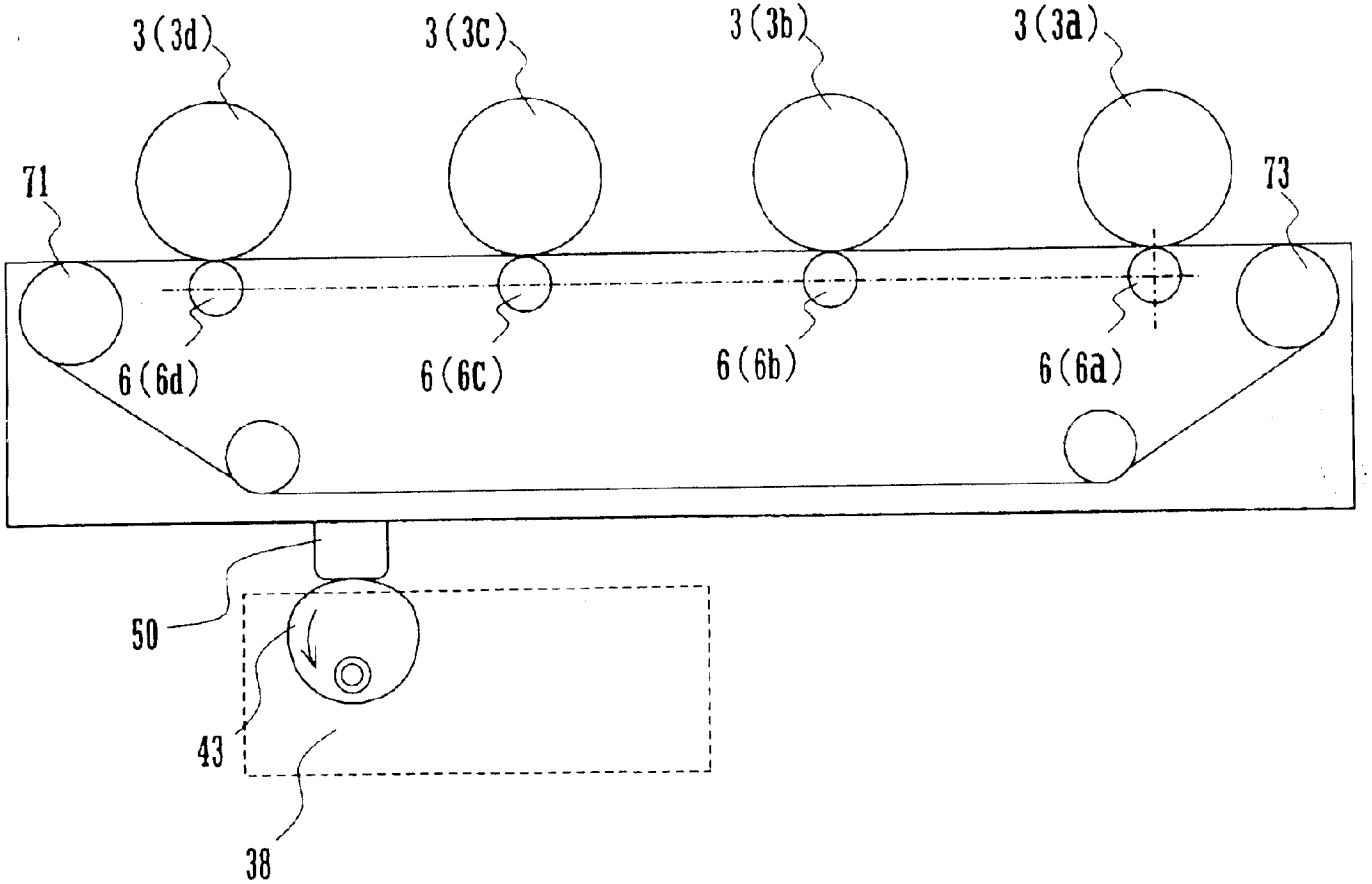
FIG. 9 is a descriptive view showing a state of a transfer carrier in a multicolor mode.
Figure 10:
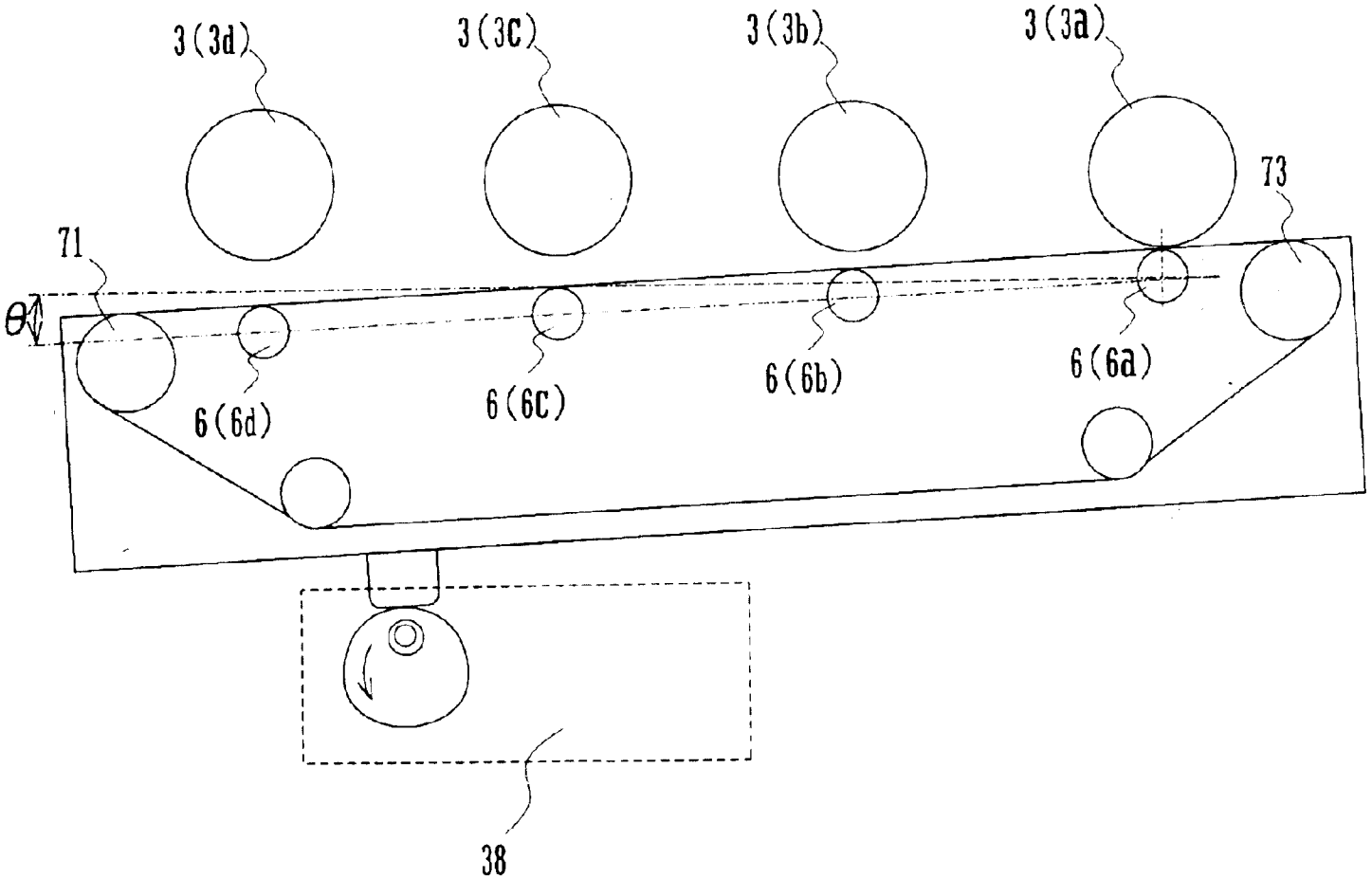
FIG. 10 is a descriptive view showing a state of a transfer carrier in a single color mode.

A change-over operation of the transfer belt 7 between both modes is realized by a change-over means 38 as shown in FIGS. 9 and 10. That is, the change-over means 38 includes a cam 43 rotated by a driving source such as a stepping motor not shown. The cam 43 is rotation driven in sliding contact with a support piece 50 of the transfer transport unit 8. By doing so, the transfer transport unit 8 is pivoted upwardly or downwardly around a shaft of the transfer roller 6*a* in the upstream side.

Transfer of toner images from the photosensitive drums 3 to a sheet are performed by the transfer rollers (6*a*, 6*b*, 6*c* or 6*d*) in contact with the rear side of the transfer belt 7. A high voltage (a high voltage of a polarity (+) opposite a charge polarity (−) of a toner) is applied to the transfer rollers 6 in order to transfer toner images by high voltage power supplies (60*a* to 60*d*) in a transfer section, or an AC high voltage is applied to the transfer rollers 6 in order to remove a charge on the transfer belt 7 depending on a situation when a sheet transport jam occurs.

A transfer roller 6 is a roller of a structure having a shaft made of a metal (for example, stainless) and of a diameter in the range of from 8 to 10 mm as a base and the surface thereof is covered with a conductive elastic material (for example, EPDM, foamed urethane or the like). A high voltage can be applied uniformly on a sheet with the help of the conductive elastic material.

A toner attached to the transfer belt 7 from a photosensitive drum 3 renders the rear surface of a sheet dirty; therefore, the toner is removed and recovered by the transfer belt cleaning unit 9.

The paper feed tray 10 is a tray storing sheets used in printing and set in the lower side of an image forming section of the image forming apparatus. The paper discharge tray 15 provided in the top portion of the image forming apparatus is a tray in which printed sheets are stacked face down. The paper discharge tray 33 provided in a side portion of the image forming apparatus is a tray in which printed sheets are stacked face up.

Provided in the image forming apparatus is the paper transport path S in the shape of a letter S to transport a sheet in the paper feed tray 10 to the paper discharge tray 15 via the transfer transport unit 8 and the fixing unit 12. Pick-up rollers 16, a resist roller 14, the fixing unit (fixing section) 12, a transport direction change-over gate 34, transport rollers 25 and the like are set in the neighborhood of the paper transport path S to as far as the paper discharge trays 15 and 33 from the paper feed trays 10.

The plural transport rollers 25 are small rollers for promoting and assisting transportation of a sheet and placed along the paper transport path S. A pick-up roller 16 is an intake roller located at an end of a paper feed tray 10 to feed a sheet from the paper feed tray 10 one sheet at a time into the paper transport path S.

The transport direction change-over gate 34 is provided rotatably on the side cover 35 and is changed over from a position shown with a solid line to a position shown by a broken line to thereby separate a sheet in transit on the paper transport path S therefrom and to discharge the sheet to the paper discharge tray 33.

On the other hand, in a case where the transport direction change-over gate 34 is in a position shown with the solid line, a sheet is discharged to the paper discharge tray 15 in the top portion through a transport path S' (part of the paper transport path S) formed between the fixing unit 12 and the side cover 35 and the transport change-over gate 34.

The resist roller 14 placed in the most upstream side of the transfer belt 7 works so as to temporarily hold a sheet transported on the paper transport path S. Furthermore, the resist roller 14 has a function to transport the sheet in good timing so as to be matched with rotation of the photosensitive drums 3 so that toner images on the photosensitive drums 3 are sequentially multiple-transferred on the sheet in good alignment.

That is, the resist roller 14 sets a sheet in transport timing so that the leading edge of a toner image on each photosensitive drum 3 coincides with the leading edge of a printing range on the sheet based on a detection signal outputted by a sheet detector A. The sheet detector A monitors a transport timing of the sheet. Jam detection or the like is effected with a signal from the sheet detector A as a reference.

The fixing unit 12 includes: a heat roller 31; a pressure roller 32 and the like and the heat roller 31 and the pressure roller 32 are configured so as to rotate while pinching a sheet therebetween. In the heater roller 31, a state of ON or OFF of a heater lamp not shown is controlled by a control section based on an output value of a temperature detector not shown so as to keep a temperature thereof at a predetermined fixing temperature, and the heater roller 31 and the pressure roller 32 cooperatively heat-compresses the sheet and to thereby, thermally fix a single color toner image or a multicolor toner image transferred onto the sheet through a process including melting and mixing and press contact.

The sheet after the toner image is fixed thereon in the fixing unit 12 is discharged selectively onto the discharge tray 33 or 15 by the transport rollers 25. In this step, a state of the sheet in transportation after the fixing is monitored by the sheet detector B, the sheet detector C and other sheet detectors not shown.

While description here is given of a color image formation apparatus, this may apply to a configuration with a single color image forming station (a monochromatic image forming apparatus). While in this embodiment, the body of the image forming apparatus is placed on a paper feed desk device having a three layer paper feed tray stack, the present invention is not limited to this particular case and a paper feed device may be selected from various kinds of types by a user.

<Construction for Jam Processing>

In this embodiment, the image forming apparatus constructed as described above is equipped with a jam processing control section for performing a jam processing with a good efficiency, easiness and certainty in a case where a jam occurs on a sheet during transportation. The control section controls a transfer bias and a transport distance of a sheet so as to be adapted for an environmental condition in a desirable embodiment.

Figure 2:
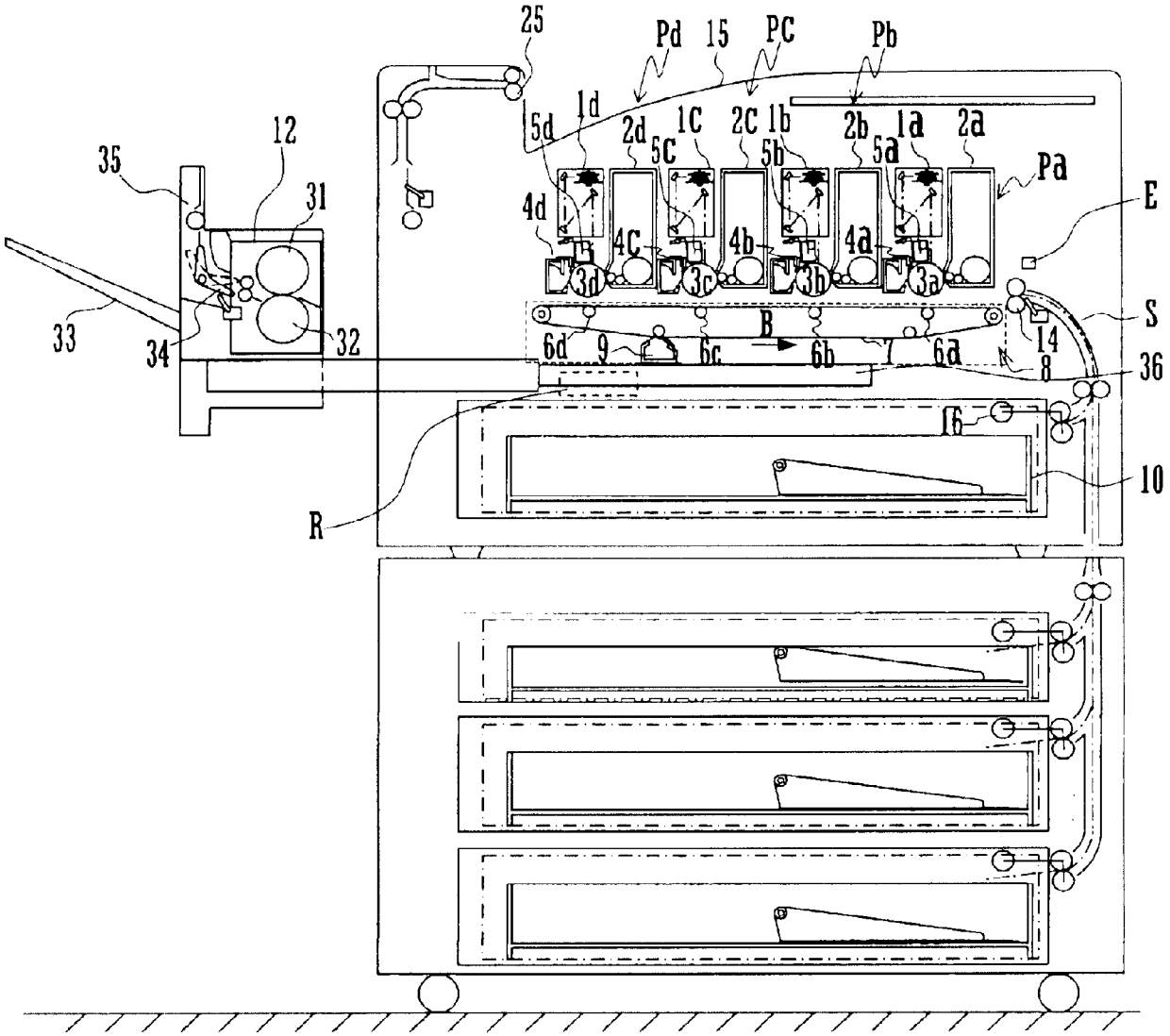
FIG. 2 is a configuration of a main section in a state where a fixing unit is drawn out.
Figure 11:
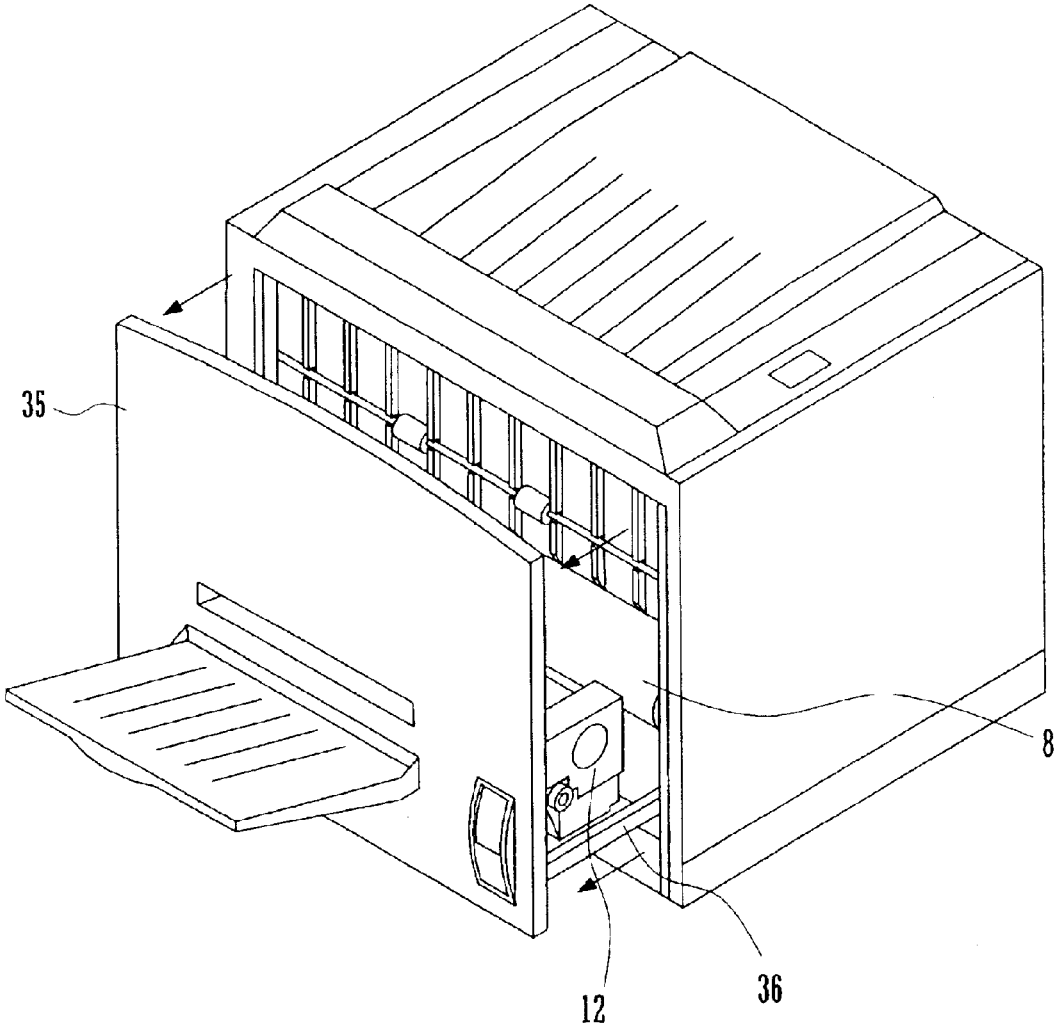
FIG. 11 is a descriptive view in a state where a fixing unit is drawn out.

The fixing unit 12 integrated into one piece with the side cover 35 having the paper discharge tray 33, as shown in FIG. 2, can be drawn out toward the downstream side in the transport direction of the transfer transport unit 8 (in a transport direction of a sheet) with the help of a slide member 36 laterally set across the both sides, front and rear, of the body of the image forming apparatus (see FIG. 11).

When a jam processing is performed, the fixing unit 12 is drawn out together with the side cover 35 from the body of the image forming apparatus and the transfer belt 7 is moved apart from all of the photosensitive drums 3, interlocking with the draw-out operation of the fixing unit 12. Furthermore, the transport belt 7 can be restored to the original state again interlocking with an accommodating operation of the fixing unit 12.

That is, in this embodiment, the image forming apparatus has a moving-apart or -close mechanism (moving-apart or -close means R) for moving the transfer belt 7 supported by the transfer transport unit 8 apart from or into contact with all of the photosensitive drums 3 (3*a* to 3*d*). The moving-apart or -close mechanism links with a slide operation (see FIG. 11) of the slide member 36 integrated with the fixing unit 12 into one piece. A construction is such that a cam mechanism, not shown, mounted to the slide member 36 is engaged with the transfer transport unit 8 and the change-over means 38 to thereby enable the transfer belt 7 to be moved apart from or into contact with all of the photosensitive drum 3, and the relationship between the transfer belt 7 and all of the photosensitive drum 3 can be restored to the original state interlocking with an accommodation operation of the fixing unit 12.

The slide member 36 can preferably perform a smooth movement while supporting the fixing unit 12 having a relatively heavy weight with a high accuracy, for example, by using a slide bearing such as a high accuracy accuride, whereas any of other slide means may be employed as far as a high accuracy positioning is enabled when the fixing unit 12 is returned to a predetermined position of the body of the image forming apparatus.

In this embodiment, the transfer transport unit 8 including the transfer belt 7, as described above, is supported so that the downstream side is pivotable relative to the body of the image forming apparatus around a fulcrum shaft, not shown, as a rotation center, provided in a housing section of the transfer transport unit 8, and located at a site on an extension of the shaft of the transfer roller 6*a* in the upstream side. A construction is adopted in which the change-over means 38 changes over between a state of a multicolor mode, shown in FIG. 9, in which the transfer transport belt unit 8 is brought into contact with all of the photosensitive drums 3 almost in parallel relative thereto and a state of a single color, shown in FIG. 10, in which the downstream side falls while only the photosensitive drum 3*a* being into contact with the transfer belt 7. Note that as detection means for detecting a position of a sheet during transportation, plural other sheet detectors similar to the sheet detectors A, B and C are equipped along the transport path S.

Description is given of control by a jam processing control section with a detection timing, as a reference, of the sheet detector A placed in the upstream side of the fixing unit 12 in flowcharts of FIGS. 13 to 16. The sheet detectors B and C placed in the downstream side of the fixing unit 12 detect states in which sheets are discharged into the discharge trays 33 and 15 and control by the jam processing control section can also be performed using the sheet detector B or C instead of the sheet detector A.

Figure 12:
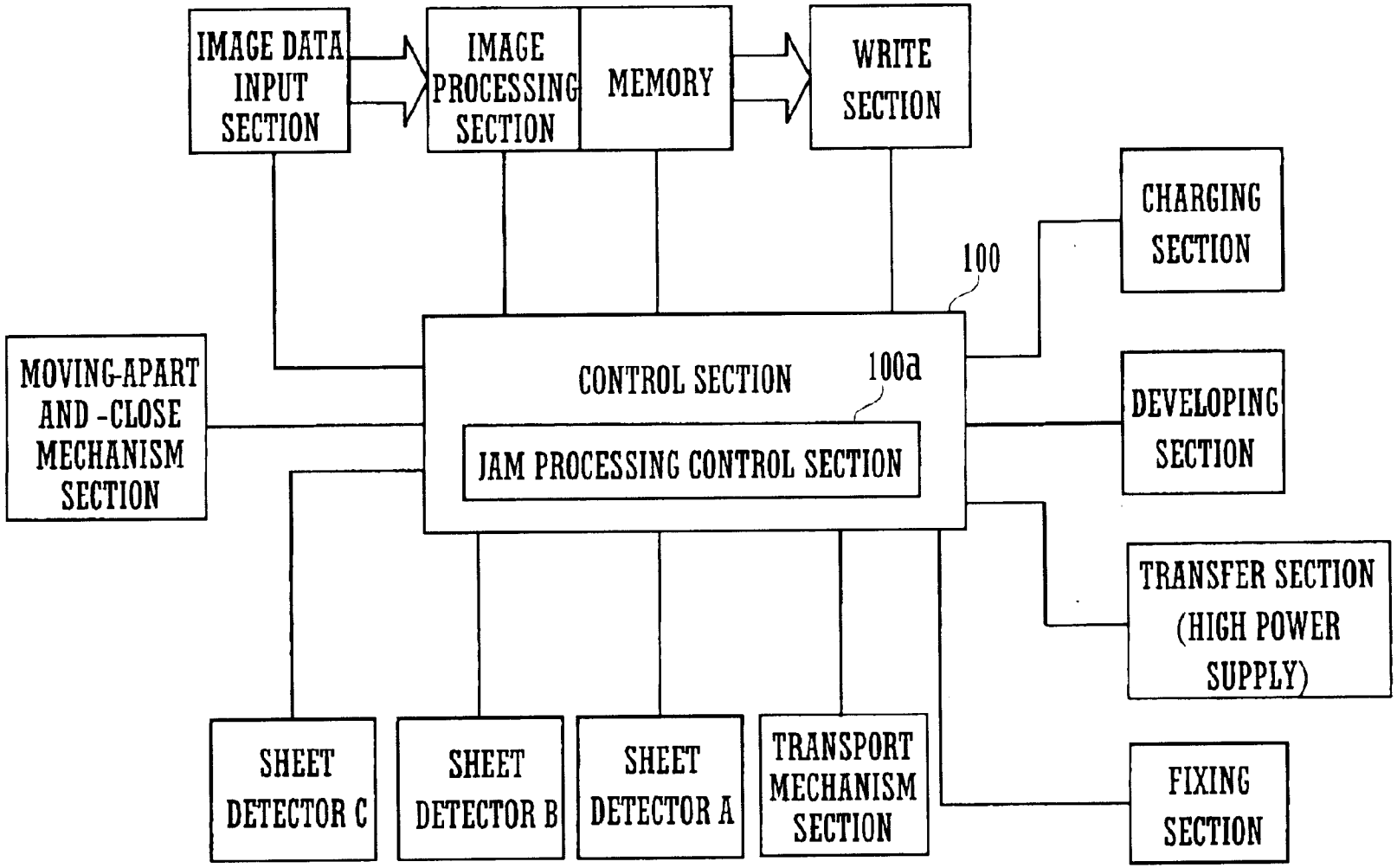
FIG. 12 is a control system block diagram of jam processing control means.

The jam processing control section 100*a,* as shown in FIG. 12 exhibiting a control system block diagram of an image forming apparatus, is incorporated in a control section including CPU, ROM and RAM and the sheet detectors A, B and C are connected to the input side thereof. Furthermore, connected to the output side are a driving source for driving the transfer belt 7, a transportation mechanism section including a crutch of the resist roller 14 as sheet transport means in the upstream side of the transfer belt 7 and others, the moving-apart or -close mechanism (including the moving-apart or -close means R and the change-over means 38) for moving the transfer belt unit 8 apart from or into contact with the photosensitive drums 3 (3*a* to 3*d*) and a high voltage power supplies 60*a* to 60*d* for supplying a transfer voltage (transfer bias) to the transfer rollers 6. Note that in the present invention, a sheet transport means in the upstream side of the transfer belt 7 is not limited to the resist roller 14 and, as described later, may includes a sheet transport roller provided along the transport path S in the upstream side of the transfer belt 7.

An environment detector E, as shown in FIG. 1, is placed at a site near the image forming process section in the image forming apparatus avoiding a site where a temperature or a humidity makes a relatively sharp alteration, such as a site near the fixing unit 12, to detect a humidity and temperature both. Note that while description here is given of the color image forming apparatus, the construction described above may apply to an image forming apparatus equipped with a single image forming station (a monochromatic image forming apparatus).

In this embodiment, the jam processing control section, when detecting occurrence of a jam, ceases transportation of sheets on the transfer belt 7 and enables removal of a sheet in the jam as a first stage. At the first stage, the fixing unit 12 is drawn out to remove the sheet in the jam. Then, if a sheet recording medium in transit when the jam occurs is detected, the process moves to a second stage. At the second stage, transportation of a sheet in transit is restarted by the transfer belt 7 and the sheet in transit is transported to the fixing unit 12. There are two modes in restarted transportation of the sheet in transit to the fixing unit 12: one in which the sheet is transported before the fixing unit 12 and the other in which the sheet is clenched between rollers in the unit.

The transfer voltage applying section, while being at the second stage, controls a transfer voltage applied to a sheet based on a measurement result of the sensor at the same second stage.

In a case where a jam occurs, a sheet in transit when the jam occurs, that is a sheet stays stagnant in the apparatus (a sheet in anomalous transportation) is taken out in the following sheet take-out processing methods:

(1) The sheet in anomalous transportation is transported to a site where it is before and not clenched between a roller pair of the heat roller 31 and the pressure roller in the fixing unit 12 and thereafter, the fixing unit 12 is drawn out to take out the transported sheet.

(2) The sheet in anomalous transportation is transported as far as to be clenched between the roller pair 31 and 32 and thereafter, the fixing unit 12 is drawn out to take out the transported sheet.

Figure 3:
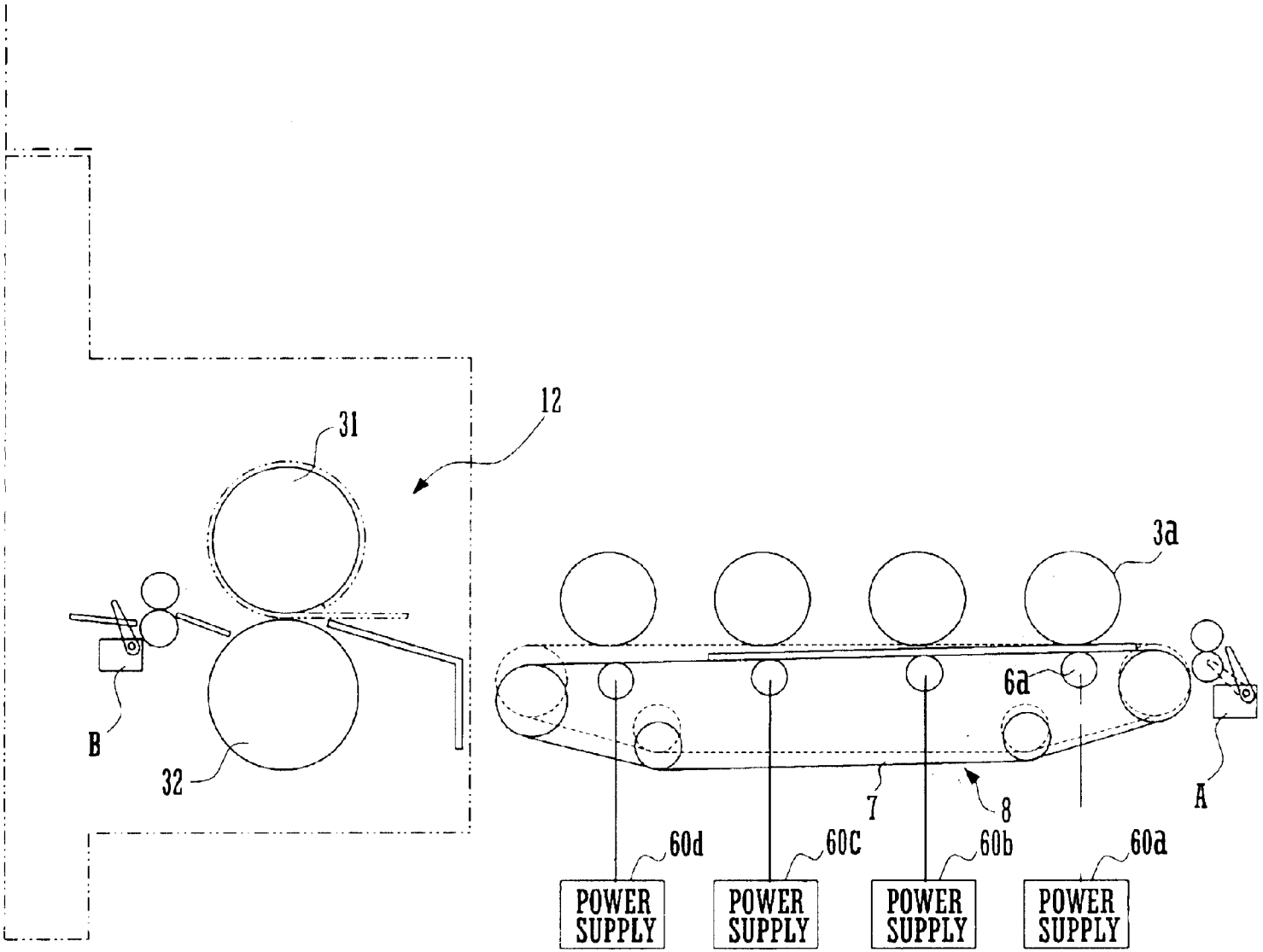
FIG. 3 is a descriptive view in a state where a transfer carrier is stopped in an emergency.

In a case where, as shown in FIG. 3, a sheet remains in the transfer transport unit 8 when a jam occurs, the process moves to the second stage to cause the transfer transport unit 8 to move apart from the photosensitive drums (3*b* to 3*d*) except the photosensitive drum 3*a* as shown with the solid line. By doing so, since no charge is given to the sheet from the photosensitive drums 3*b* to 3*d* other than the photosensitive drum 3*a* and the transfer rollers 6*b* to 6*d* other than the transport roller 6*a,* an attraction force can be (properly) reduced by an amount corresponding to the no charge given to the sheet.

Figure 5:
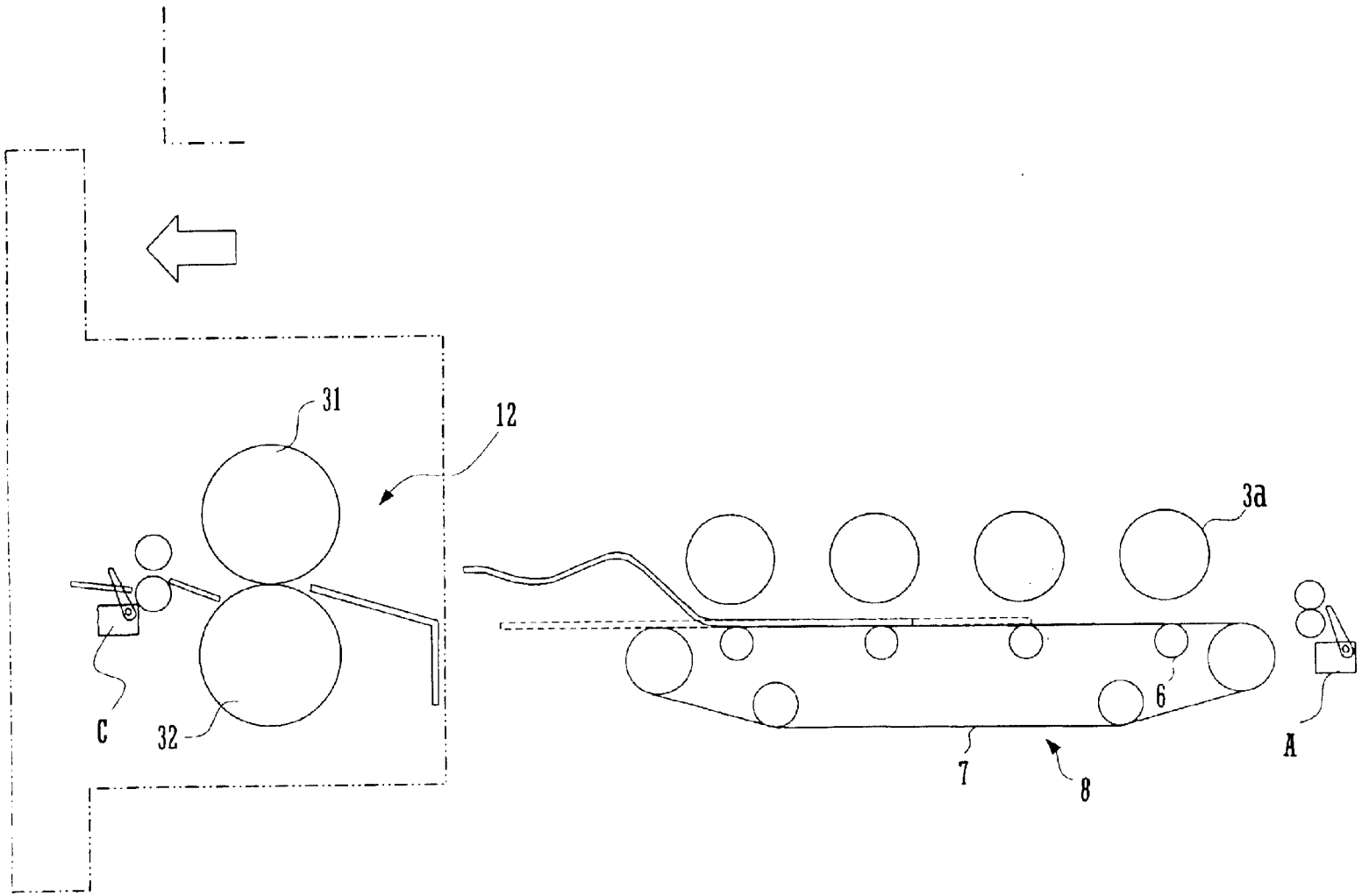
FIG. 5 is a descriptive view in a case where a fixing unit is drawn out to perform a jam processing.

In succession, in the first sheet take-out processing method, the sheet is transported before the fixing unit 12 (in a state where the sheet is not clenched between the roller pair). Thereafter, the fixing unit 12 is, as shown in FIG. 5, drawn out in a direction toward the left side surface of the image forming apparatus (a direction of an arrow in FIG. 5) and the sheet remains in the transfer transport unit 8 side.

If a transport distance is large (for example, at a low humidity) in this step, the leading edge of the transported sheet is brought into contact with the roller members 31 and 32.; therefore, as shown with a solid line, the sheet is irregularly bent to reduce a portion of the sheet firmly attracted to the transfer belt 7 to the shortest possible width. On the other hand, if a transport distance is small (for example, at a high humidity), a portion of the transported sheet firmly attracted to the transfer belt 7, as shown with a broken line, becomes more. Note that in FIG. 5, the side cover 35 is opened (see FIG. 11) and all of the photosensitive drums 3 are moved apart from the transfer transport unit 8 by the action of the cam structure, not shown, describe above, interlocking with the operation in which the fixing unit 12 is drawn out; therefore, the sheet is in a state where to be peeled off from the transfer belt 8 with ease.

Note that in a case where a sheet is transported so as not to be clenched between the roller members 31 and 32, the interior of the image forming apparatus (particularly, in the peripheral region of the fixing unit 12) is made dirty by an unfixed developing agent already transferred onto the sheet, which depends on a value of bending of the sheet; therefore, it is unpreferable to set a transport distance to be longer.

Figure 4:
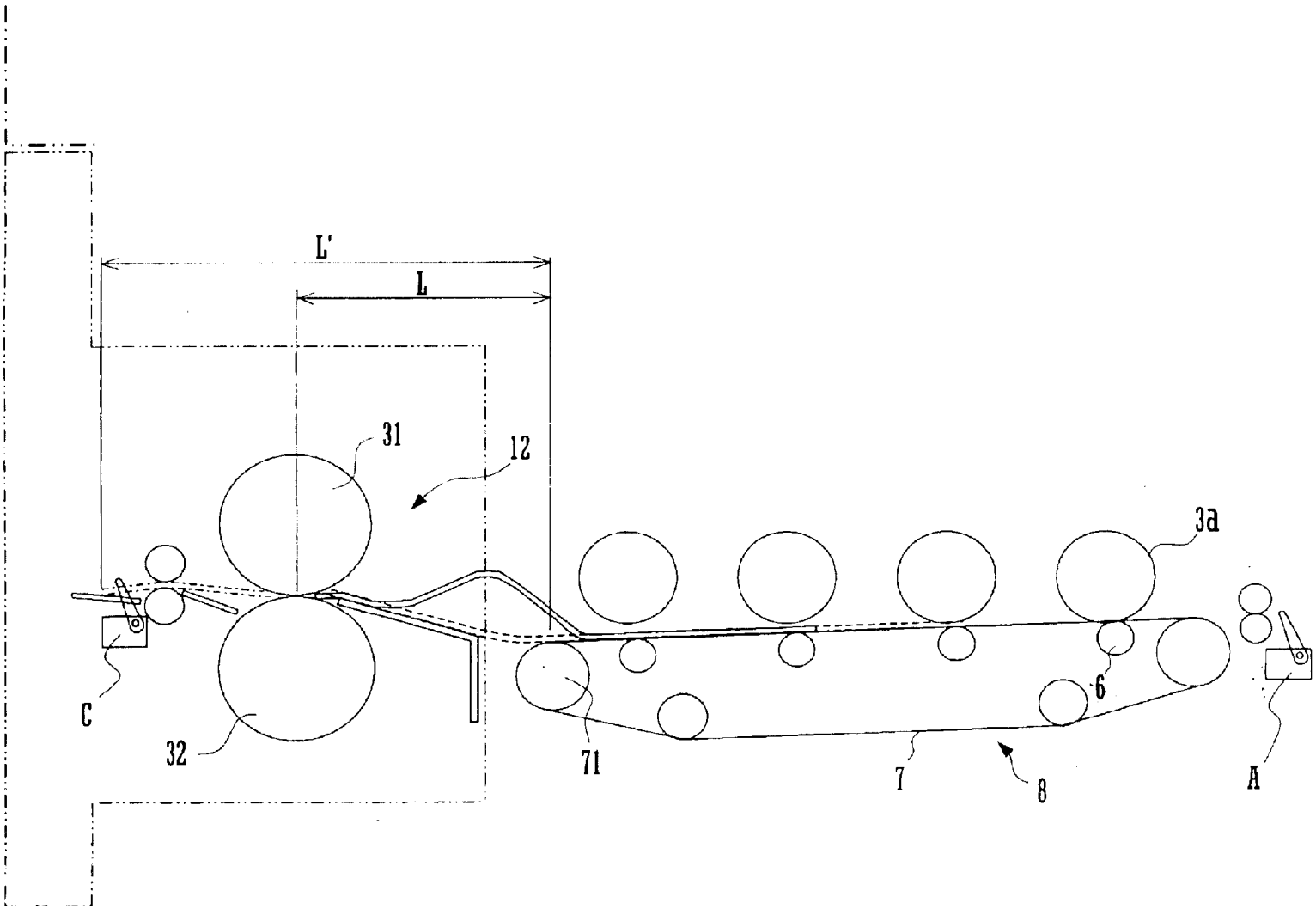
FIG. 4 is a descriptive view in a state where a sheet recording medium remains on a transfer carrier.
Figure 7A:
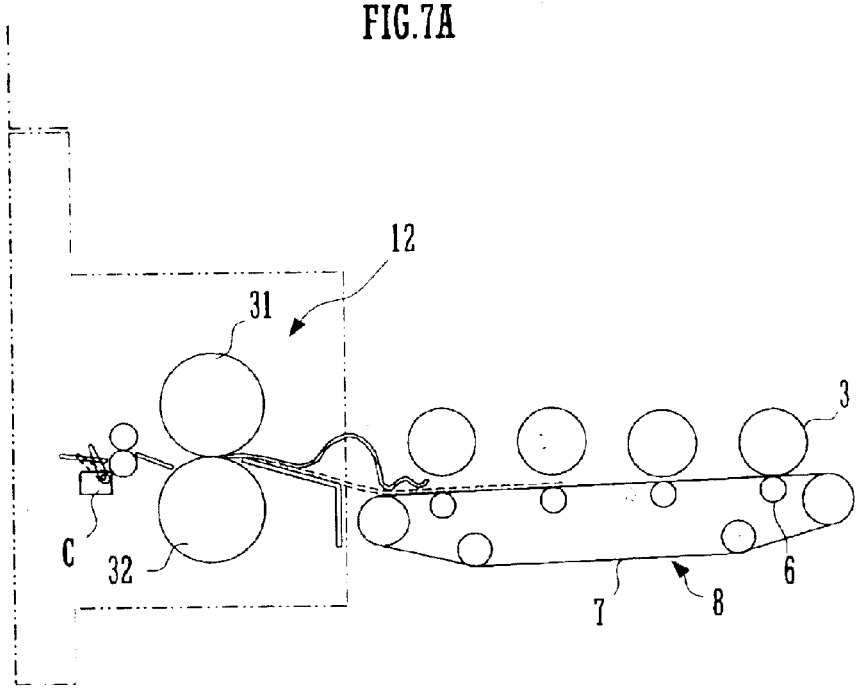
FIGS. 7A and 7B are descriptive views in a case where two recording media remain on a transfer carrier and a jam processing is performed.

On the other hand, in the second sheet take-out processing method, the sheet in anomalous transportation is, as shown in FIG. 4, transported as far as to be clenched between the roller members 31 and 32 of the fixing unit 12. Thereafter, the fixing unit 12 together with the side cover 35 is, as shown in FIG. 7, drawn out in a direction toward the left side (a direction of an arrow of FIG. 7) and the sheet is drawn out together with fixing unit 12 in a state where being peeled off the transfer belt 7. Note that an alternate long and short dash line of FIG. 4 shows a transport distance (L') of the sheet clenched between the roller members 31 and 32 in rotation while if rotation of the roller members 31 and 32 is ceased, the sheet is controlled so as to be as shown with a solid line or a broken line of FIG. 4. L shows a distance between a transfer belt driving roller in the most downstream side and the roller pair 31 and 32.

FIG. 6 shows an example of a case where the roller members 31 and 32 is kept in rotation, wherein though a transport distance of the sheet is set longer and the same transport distance as in the solid line of the FIG. 4, no bend occurs in the sheet. Therefore, it can be prevented to make the interior of the image forming apparatus dirty with an unfixed toner.

Note that while the sheet take-out processing methods shown in FIGS. 3 to 6A and 6B is performed at least at the second stage, the methods may also be applied at the first stage.

In any of the first and second take-out processing methods, it is necessary to properly control an attraction force by which a sheet is firmly attracted to the transfer belt 7. That is, with a smaller attraction force, a sheet staying stagnant in the apparatus is taken out with ease. An attraction force between a sheet and the transfer belt 7 is greatly affected by a transfer voltage (transfer bias) applied through the transfer belt 7 and a charge on the image carrier caused by the transfer bias.

Since the attraction force is an electrostatic force, the attraction force is greatly altered by an environmental condition such as a temperature and a humidity (especially a humidity). Hence, with an excessively weak attraction force, a sheet cannot be transported. On the other hand, with an excessively strong attraction force, a sheet is harder to be peeled off.

Control of a transfer bias adapted to the environmental condition is performed based on experimental results about a relationship between a transfer bias and a jam processing. The experiments were conducted in two cases of a combination of an ordinary temperature and an ordinary humidity (NN) and a combination of a low temperature and a low humidity (LL), from which the results of the experiments shown in FIG. 19 were obtained. Note that the environment detector E (sensor) is placed at a site near the image forming process section in the image forming apparatus avoiding a site where a temperature or a humidity makes a relatively sharp alteration with ease, such as a site near the fixing unit 12, to detect a humidity and a temperature (see FIG. 1). In FIG. 19, a sheet of A4 size (210 mm×297 mm) is employed and L is set at 100 mm (see FIG. 4).

As shown in FIG. 19, in a case where an environmental condition is set at the combination of an ordinary temperature and an ordinary humidity (NN) (a temperature of 25° C. and a humidity of 50%) and if a transfer bias is set to 2 KV or 3 KV, good results are obtained on peelability, transportability and dirtiness in the peripheral region. At other settings (0 KV and 0.5 KV), peelability and transportability are problematical.

On the other hand, in a case where an environmental condition is set at the combination of a low temperature and a low humidity (LL) (a temperature of 5° C. and a humidity of 30%), an attraction force is higher with a higher transfer bias; therefore a transfer bias lower than in the case of the combination of an ordinary temperature and an ordinary humidity (NN) is preferably applied and if the transfer bias is set to 0.5 KV, good results are obtained on peelability, transportability and dirtiness in the peripheral region. At other settings of (2 KV and 3 KV), peelability is problematical and at a setting of 0 KV, peelability and transportability are both problematical.

It is found from the results that it is preferable that in the case of the combination of an ordinary temperature and an ordinary humidity (NN), a transfer bias is set to 2 KV and in the case of the combination of a low temperature and a low humidity (NN), a transfer bias is set to 0.5 KV. A mark L in the table indicates a distance between the transfer belt driving roller 71 in the most downstream and the heat roller 31 and a mark L' in the table indicates a distance between the transfer driving roller 71 and the leading edge of a sheet, which is shown in FIG. 4.

Note that in a case where the transfer belt 7 ceases its movement, a transfer bias is set to OFF.

In this embodiment, an application range (length) of a transfer bias applied on a sheet is controlled so as to be adapted for an environmental condition. In experiments on a relationship between an application range (length) and a jam processing, as shown in FIG. 20, there are adopted three kinds of environmental conditions such as a combination of a high temperature and a high humidity (HH), a combination of an ordinary temperature and an ordinary humidity (NN) and a combination of a low temperature and a low humidity (LL). In FIG. 20, a sheet of A3 size (297×420 mm) is employed, L is set to 100 mm (see FIG. 4) and a transfer bias is set to 2 KV.

In a case of the combination of a high temperature and a high humidity (HH) (a temperature of 35° C. and a humidity of 85%) and if an application range (length) is set to all the surface of a sheet, good results are obtained on peelability and transportability, while if an application range is set to 50 mm in the tail end side, peelability and transportability are problematical.

In a case of the combination of an ordinary temperature and an ordinary humidity (NN) (a temperature of 25° C. and a humidity of 50%) and if an application range (length) is set to 50 mm in the tail end side, good results are obtained on peelability and transportability, while if an application range is set to all the surface of a sheet, peelability is problematical.

In a case of the combination of a low temperature and a low humidity (LL) (a temperature of 5° C. and a humidity of 30%) and if an application range (length) is set to 50 mm in the tail end side, good results are obtained on peelability and transportability, while if an application range is set to all the surface of a sheet, peelability is problematical.

It is found from the results that it is preferable that in the case of the combination of a high temperature and a high humidity (HH), an application range (length) of a transfer bias is set to all the surface of a sheet while in the cases of the combination of an ordinary temperature and an ordinary humidity, and the combination of a low temperature and a low humidity, an application range (length) thereof is set to 50 mm in the tail end side. Needless to say, however, that the application range (length) is not limited so as to be described above and may be set to a more proper range (length) according to not only a characteristic of an image forming apparatus but also a kind of a sheet recording medium in use, an the like. Note that, as shown in FIG. 4, a mark L indicates a distance between the transfer belt driving roller 71 and the heat roller 31 and a mark L' indicates a distance between the transfer belt driving roller 71 and the leading edge of a sheet.

While in a case where a jam processing operation is conducted, as described above, the fixing unit 12 is drawn out from the body of an image forming apparatus and thereby, the fixing unit 12 is exposed in the air outside to perform a jam processing on both sides, front and rear, thereof, in a case where a sheet stays stagnant between a photosensitive drum 3 in the upstream side and the transfer belt 7, it is difficult to find, in more of case, the sheet since an access to the image forming section in which a jam occurs, as shown in FIG. 11, is made on the sides through the exposed sections thereof.

Especially, a sheet small in size is more of cases overlooked. Therefore, in a jam processing, a transfer bias is controlled by the jam processing control section in the following way in consideration of the results of experiments so that a sheet that is thus hard to find, which stays stagnant at a position in the upstream side, can be found with certainty and removed with ease. Note that description is given of control of a jam processing in a multicolor mode using all the photosensitive drums 3.

That is, in the control, fundamentally, when occurrence of a jam is detected, transportation of a sheet caused by the transfer belt 7 is ceased as the first stage so as to enable the sheet in the jam to be removed and then, when a sheet in transit when a jam occurs is detected, the process advances to the second stage to restart transportation of the sheet in transit with the transfer belt 7 and the sheet is transported to the fixing unit 12 and is stopped there. Control of the transfer bias is conducted at least at the second stage, while the control may be conduct at the first stage.

Description will be given of a flowchart of FIG. 13.

When a transport jam occurs after the start of image forming operation, all of the following operations associated with image forming are urgently ceased (for example, a write operation to the photosensitive drums 3 performed by the exposure units 1, rotation operations of the photosensitive drums 3, charging operations with chargers 5, developing operations performed by the developers 2, application operations of a transfer bias with transfer rollers 6, transportation of a sheet recording medium, a fixing operation in the fixing unit) (S1 to S3) and simultaneously the change-over means 38 is activated to move the transfer belt 7 apart from the photosensitive drums 3*b,* 3*c* and 3*d* except the photosensitive drum 3*a* (S4). This is to disconnect supply of charging from the photosensitive drums 3*b* to 3*d* working for firmly attracting the sheet to the transfer belt 7 as well and to thereby reduce a force required to peel off the sheet from the transfer belt 7, which follows.

Note that in a case where an inversion development is employed, charging operations of the chargers 5 are necessary operations in rotation of the photosensitive drums 3 regardless of image forming. This is because if the photosensitive drums 3 are not charged while being rotated, the developing agent is attached onto the photosensitive drums 3. Therefore, in a case where the photosensitive drums 3 rotate in company with transportation of a sheet recording medium in S 9 (and S9' of FIG. 14) to come later, a charging operation of the charger 5*a* is conducted to the photosensitive drum 3*a* in rotation.

While description is given above of a case where the transfer belt 7, in step S4, are moved apart from the photosensitive drums 3*b* to 3*d* except the photosensitive drum 3*a,* a similar effect can be obtained by turning off a transfer bias to be applied to the transfer rollers 6*b* to 6*d* or by setting a transfer bias to a proper value without moving the transfer belt 7 apart from the photosensitive drums 3.

In the above step S4, a display of occurrence of a jam is presented on an operating section and an operator conducts a jam processing (restoration operation) after the transfer belt 7 is moved apart from the photosensitive drums 3*b* to 3*d* except the photosensitive drum 3*a* (S5). The stage is the first stage.

The restoration operation at the first stage is realized by drawing out the fixing unit 12 from the body of the image forming apparatus to thereby again move the transfer transport belt unit 8 and to move the photosensitive drum 3*a* and the transfer belt 7 perfectly from each other (by the moving-apart or -close mechanism). With the restoration operation applied, for example, a sheet wound around on the heat roller can be removed, as shown in FIG. 3. Note that the perfectly spaced apart states are shown in FIGS. 5, 6B, 7B and 8B.

The jam processing is performed, for example, as control in a case where a sheet does not reach a detector (for example the sheet detector B) located in the downstream of the fixing device and it is determined that a jam occurs in the fixing unit 12. After the jam processing ends, the fixing unit 12 is inserted into the body of the image forming apparatus to thereby restore the transfer transport unit 8 to a state before the fixing unit 12 is drawn out. Note that in step S13, a current to be supplied to a heater of the fixing unit 12 is shut off for safety.

Then it is determined, in step S6, whether or not there is present another sheet passing through the sheet detector A based on information on a state of the sheet detector A being monitored when a jam occurred on the previous sheet. It is determined in Step S7 whether or not there is present a sheet sandwiched between the resist rollers 14 by the sheet detector A. In a case where there is present the sheet in step S6 or S7, the process advances to the second stage.

In the second stage, a transfer bias is set so as to adapted for an environmental condition and the transfer bias is applied to the sheet (S8).

Then, transportation of a sheet is, in step S9, started while the fixing unit 12 ceases its operation and transportation of a sheet, in step S10, is ceased in a state where the sheet is clenched between the roller members 31 and 32 of the fixing unit 12, from which the sheet is taken out with ease (a state of the sheet shown with the broken line of FIG. 4) or a state where the sheet is before being clenched between the roller members 31 and 32 (a state of the sheet shown with the solid line of FIG. 4). In transportation of the sheet, a transfer bias is applied to the sheet so as to be adapted for an environmental condition, thereby enabling transportation of the sheet with certainty.

In this step, a moving-apart state of the transfer belt 7 from the photosensitive drums 3 is maintained and supply of charge to the sheet from the photosensitive drums 3*b* to 3*d* also working for firmly attracting the sheet to the transfer belt 7 is disconnected. This is to reduce a force required to peel of f the sheet from the transfer belt 7, which is conducted later.

In this embodiment, since a transfer bias is applied so as to be adapted for an environmental condition to the sheet through the transfer belt 7, an attraction force of the sheet can be properly held despite alteration in environmental condition. With such workings, no failure in sheet transportation is provoked and the sheet can be transported by a predetermined distance with certainty. After the sheet is transported (S10), an operator, in step S11, disengages the fixing unit 12 to perform a second jam processing (restoration operation).

Since the transfer transport unit 8, in the step S11, moves to a position where it is apart from all the photosensitive drums 3 by the moving-apart or -close mechanism in links with a disengage operation of the fixing unit 12, the leading edge of the remaining sheet is, as shown in FIG. 5, pinched with ease to thereby conduct a jam processing with ease. Since application of a transfer bias is ceased immediately after a jam occurs and the transfer belt 7 is moved apart from the photosensitive drums 3*b* to 3*d*, an attraction force of the sheet firmly attracted to the transfer belt 7 is lowered. Therefore, the sheet is in a state where it is easily peeled off from the transfer belt 7.

If the fixing unit 12 is restored to the original state after the jam processing ends, the process returns to step S7. Stagnant residence of a sheet in this step is again detected by the sheet detector A. If there is no stagnant residence of a sheet, the process advances to step S12 to operate the change-over means 38 there and to bring the transfer belt 7 into contact with all the photosensitive drums 3. Thereafter, a pre-rotation operation, which is a preliminary operation in the process section, (an operation for preparing cleaning or the like of the photosensitive drums 3 and the transfer belt 7), in step S13, is started and the pre-rotation operation, in step S14, completes, and then, a ready lamp in the operation section, in step S15, is lit up and the image forming section enters a standby state where an image can be formed.

On the other hand, in a case where it is determined, in step S6 that no sheet stays stagnant on the transfer belt 7 and no sheet, in Step S7, is detected by the sheet detector A, it is determined that the jam processing is perfectly completed. In such a case, the process advances to step S12, where the transfer belt 7 is brought into contact with all the photosensitive drums 3. Thereafter, the process advances to steps S13 and S14 and a ready lamp is lit up that indicates that image forming operation is fully prepared after the pre-rotation operation described above ends (S6 to S15). While in this embodiment, the ready lamp is lit up to thereby urge the restart of operation, an image forming operation may be restarted automatically.

In such a way, the fixing unit 12 is drawn out from the body of the image forming apparatus to firstly perform jam processing at the first stage. Thereafter, the fixing unit 12 is restored to the original position and if there is present a subsequent sheet remaining in the upstream side of the image forming apparatus, the process advances to the second stage. At the second stage, the sheet is transported to a site in the downstream side where the sheet is easily taken out under an attraction force suitably adapted to an environmental condition. The jam processing is conducted for the second time and a restoration operation can be performed with certainty without leaving any sheet behind. The site where a sheet is easily taken out has only to be in the vicinity of the entrance to the fixing unit 12. For example, at least part of the sheet has only to be located in a position in a space bridging the area of the fixing unit 12 and the area of the transfer belt 7.

Note that in a case where it is determined that a jam occurs, driving of some of the sheet transport means in the upstream side including the resist rollers 14 is ceased. In a case where there is present a sheet that is clenched between the resist rollers 14 and thereby enters the region of the transfer belt 7, the sheet is transported by the transfer belt 7 till or a site before the leading edge thereof is clenched between the roller members 31 and 32 of the fixing unit 12 by the transfer belt 7. In this situation, a resist roller 14 is rotation-driven by a roller 14 in the driving side with the help of unidirectional crutches not shown provided between the roller 14 in the driven side and a driving system. Rollers pinching a sheet in the upstream side including the resist rollers 14 may be driven.

Description will be given of another embodiment.

In this embodiment, it is possible, at the second stage described above, to take out a subsequent sheet staying stagnant in the upstream side on emergency shutdown with more certainty.

Figure 14:
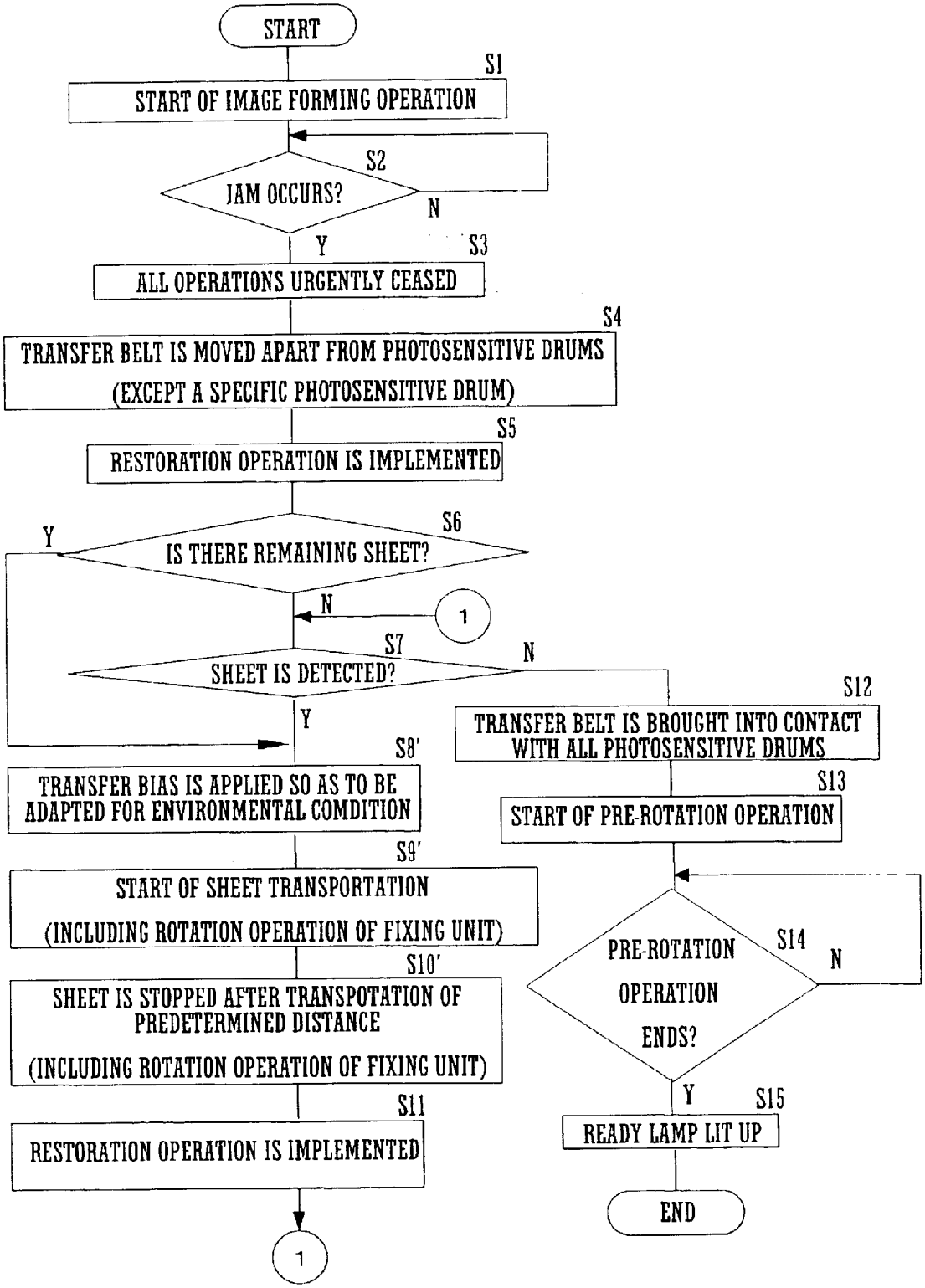
FIG. 14 is a flow chart showing another example of the jam processing control.

FIG. 14 shows a flowchart of this embodiment.

Figure 6A:
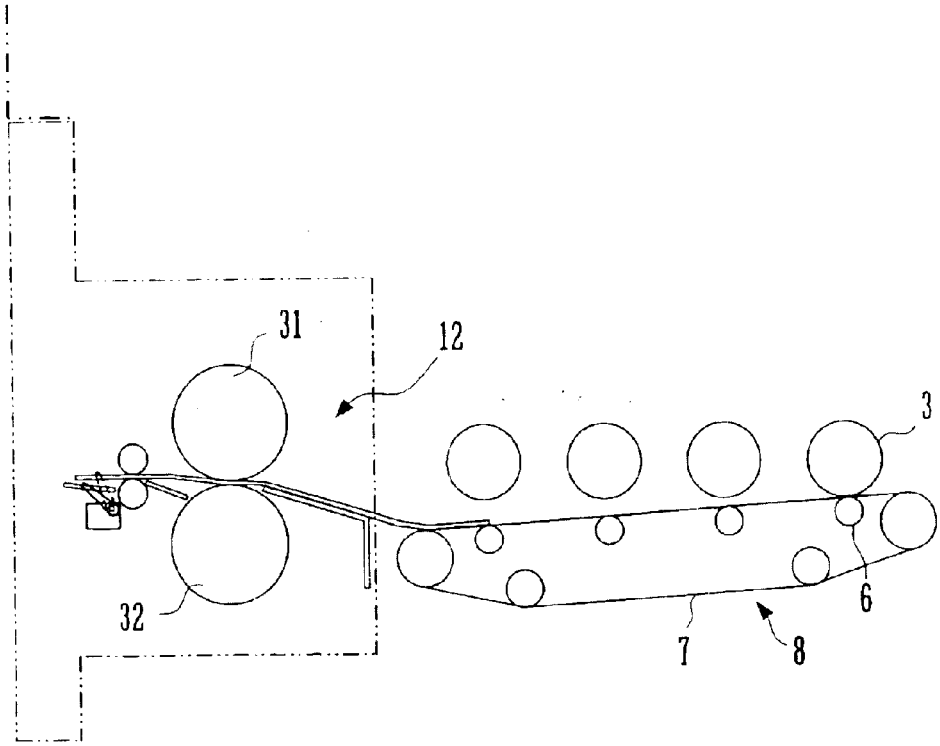
FIGS. 6A and 6B are descriptive views in another example in a case where a fixing unit is drawn out to perform a jam processing.

That is, a transfer bias is set so as to be adapted for an environmental condition and a transfer bias is applied to a sheet (S8') and thereafter, a rotation operation of the fixing unit 12 is started when sheet transportation is started. A procedure may also be adopted that the transfer belt 7 is driven by a predetermined time, for example, as shown in FIG. 6A, a time required to cause the sheet to be clenched between the fixing rollers (roller members) 31 and 32 before transportation of the sheet is ceased (S9') and thereafter, transportation of the sheet is ceased (S10') to thereby complete a jam operation.

Figure 6B:
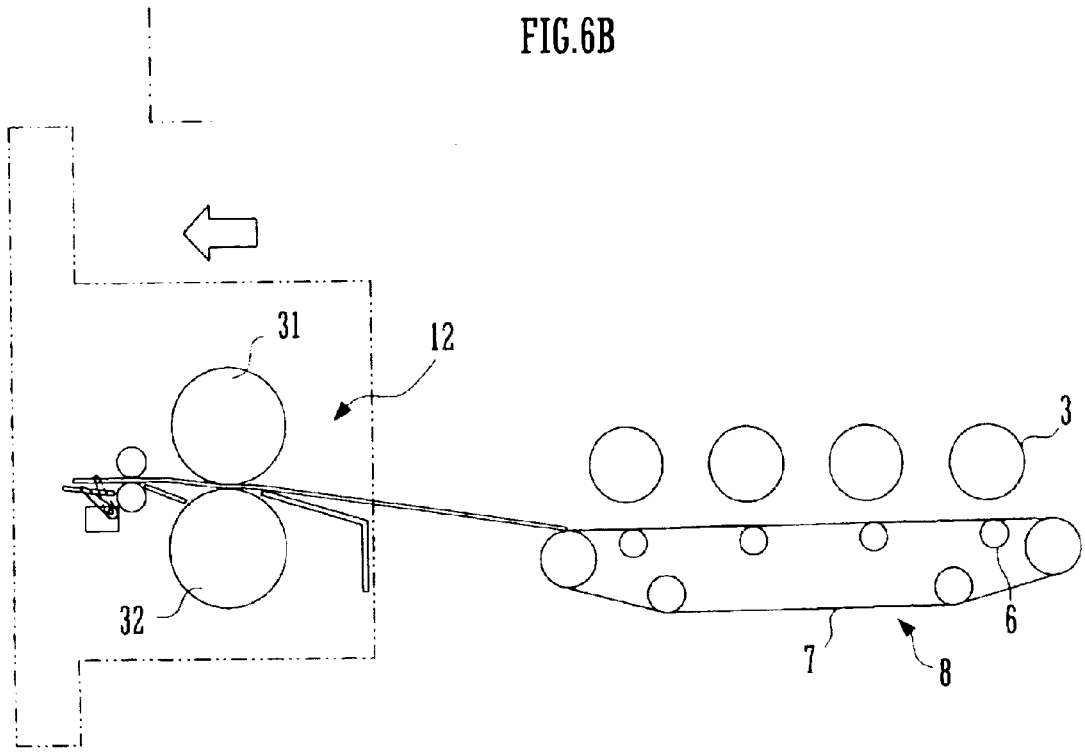

In this case, when the fixing unit 12 is drawn out from the body of the image forming apparatus, a sheet clenched between the fixing rollers 31 and 32, as shown with a solid line in FIG. 6B, can be taken out with ease from the interior of the image forming apparatus and an operation in which the sheet is peeled off from the transfer belt 7 with ease. In such a way, by setting a series of sheet transportation steps from S9' to S10', even a sheet of a small size can be transported out to a site where the sheet is in a state to be clenched between the rollers 31 and 32 of the fixing unit 12 and is taken out with ease without falling the sheet in the interior of the image forming section.

Description will be given of still another embodiment.

In this embodiment, an operation of the transfer belt 7 in the upstream side of the fixing unit 12, when a jam is detected, is not ceased immediately.

Figure 15:
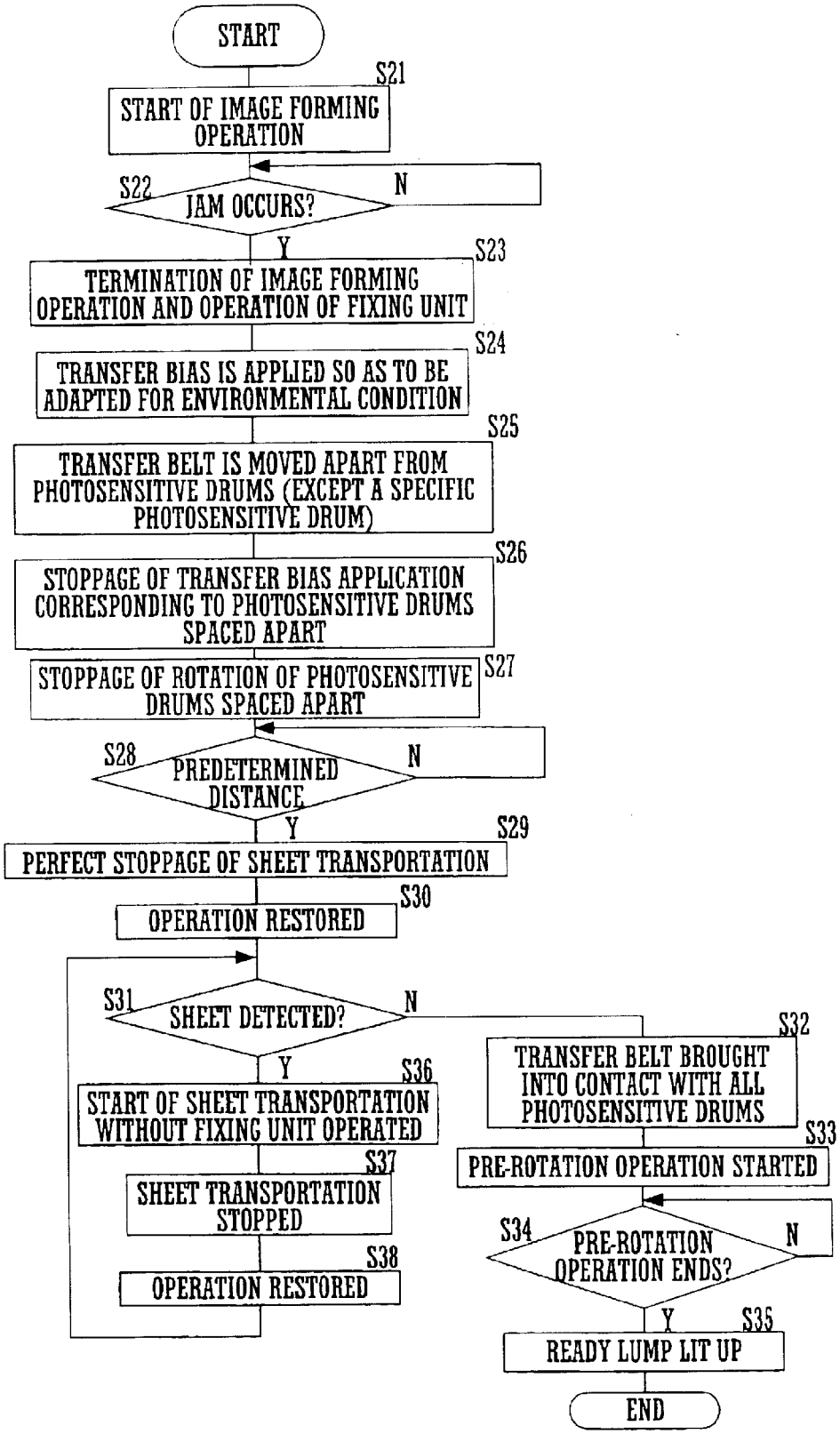
FIG. 15 is a flow chart showing still another example of the jam processing control.

FIG. 15 shows a flowchart of this embodiment.

That is, as shown in FIG. 15, in a case where a jam occurs after the start of an image forming operation (S21 to S22), the following operations are ceased: an image forming operation (a write operation to a photosensitive drum 3 with an exposure unit 1, a developing operation by a developer 2 and the like), and an operation of the fixing unit (a heating operation with a heater and rotation operations of the rollers 31 and 32) (S23). Then, a transfer bias is set so as to be adapted for an environmental condition to apply the transfer bias to a sheet (S24). Therefore, in this embodiment, control of a transfer bias is conducted so as to be adapted for an environmental condition at the first stage.

Note that termination of an image forming operation in step S23 (or S43) is to cease exposure operations by the exposure units 1 and developing operations of the developers 2. Termination of a developing operation of the developer 2 is implemented by control of application of a transfer bias or control of a distance (moving-apart or -close) between the developer 2 and a photosensitive drum 3.

Furthermore, the change-over means 38 is operated to move the transfer transport unit 8 by pivoting it and to move the transfer belt 7 apart from the photosensitive drums 3*b* to 3*d* (S25). This is because as described above, an attraction force of a sheet to the transfer belt 7 is reduced to the lowest possible level to thereby facilitate the sheet to be peeled off from the transfer belt 7 and also because images already formed on the photosensitive drums 3*b* to 3*d* are prevented from being transferred to a sheet.

Simultaneously, application of a transfer bias to the transfer rollers 6*b* to 6*d* is also ceased (S26). This is to reduce an attraction force of a sheet to the transfer belt 7. In a case where an attraction force of the sheet to the transfer belt 7, in this step, is hard to decrease, the attraction force may be positively reduced by changing over from a high voltage application to the transfer rollers 6*b* to 6*d* described above to an AC high voltage output.

Then, the sheet firmly attracted on the transfer belt 7 is continually transported in a state of being not in contact with the photosensitive drums 3*b* to 3*d,* and transportation of the sheet is ceased after transportation of the sheet is continued by the transfer belt 7 for a time till the leading edge of the sheet sufficiently intrudes into the area of the fixing unit 12 (S28 and S29). This is because in a case where two sheet is transported on the transfer belt 7, the leading sheet and the subsequent sheet are gathered before the roller members 31 and 32 of the fixing unit 12 to thereby conduct a jam processing for both simultaneously (at one time).

In this step, the subsequent sheet is pinched between the resist rollers 14 or the like, which is a transport means located in the upper stream, the roller members are driven to thereby transport the sheet smoothly.

That is, in this embodiment, an image forming operation and a rotation operation of the fixing unit 12 are ceased immediately after a jam occurs, transportation of a sheet is conducted by conducting control on a transfer bias so as to be adapted for an environmental condition at the first stage, transportation of the sheet is perfectly ceased when a predetermined time elapses to reach a state as shown in FIG. 7. A restoration operation is conducted in step S30.

Figure 7B:
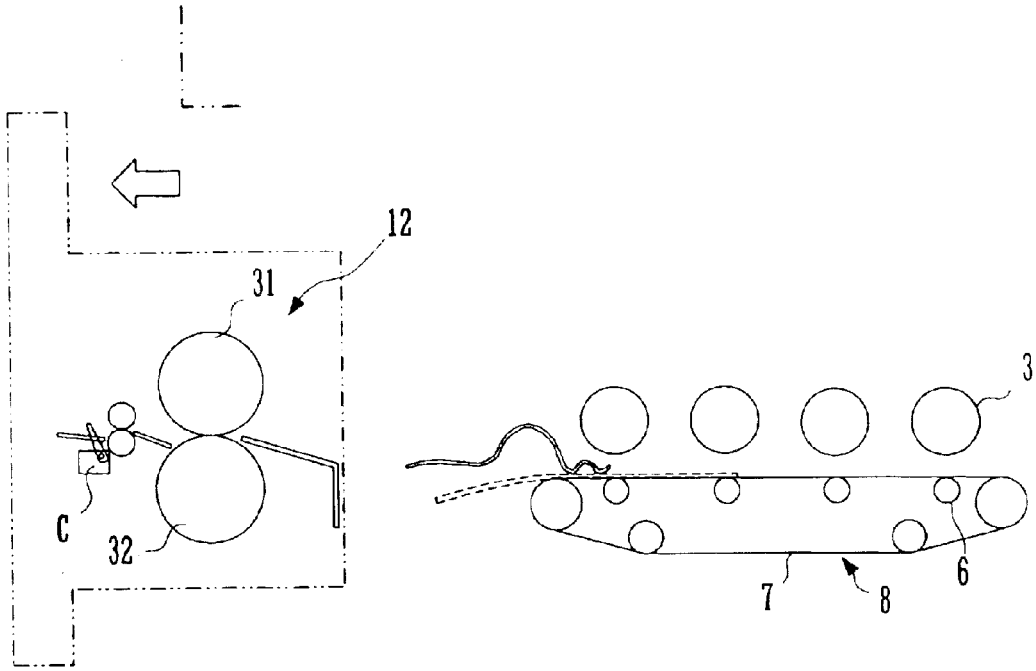

That is, with a draw-out operation of the fixing unit 12 from the body of the image forming apparatus as shown in FIG. 7B applied by an operator, the transfer transport unit 8 is further moved by the moving-apart or -close mechanism interlocking with the draw-out operation to cause the transfer belt 7 to be spaced apart from all the photosensitive drums 3. The operator implements a restoration operation (jam processing) to take out two sheets as described above. After the jam processing ends, the fixing unit 12 is inserted into the body of the image forming apparatus to restore the transfer transport unit 8 to the original state (in a state where only the photosensitive drum 3*a* is in contact with the transfer belt 7).

Then, it is confirmed in step S31 whether or not a sheet stays stagnant at the resist rollers 14 by the sheet detector A and if residence of a sheet is confirmed, transportation of the sheet is conducted till the leading edge of the sheet staying stagnant intrudes or sufficiently intrudes into the area of the fixing unit 12 as described above in steps S36 and S37 and then, the operator, in step S38, again conducts a restoration operation.

After the restoration operation, the process again returns to step S31 to confirm a residence state of a sheet. In a case where, no residence of a sheet, in step S31, is recognized, it is determined that the restoration operation (jam processing) is completed and the process advances to step S32 to cause the transfer belt 7 to be brought into contact with all the photosensitive drums 3.

Thereafter, in step S33, a pre-rotation operation, which is a preliminary operation of the process section (a preparation operation such as cleaning of the photosensitive drums 3 and the transfer belt 7) is started; the pre-rotation operation, in step S34, ends; and thereafter, a ready lamp in the operation section, in step S35, is lit up entering a standby state capable of image forming.

The process returning from step S31 to steps S36 to S38 and to S31 is a series of operations conducted for making sure a previous jam processing, which is the same series of operations as that returning to steps S8 to S10 and to S7; therefore, description of the process is omitted.

Description will be given of still another embodiment.

In this embodiment, a jam processing is performed easily and surely with good efficiency. The interior of the image forming apparatus is not made dirty with an unfixed toner.

That is, a jam processing is performed gathering plural sheets before the rollers 31 and 32 of the fixing unit 12 and the jam processing is performed in a state where the leading sheet is clenched between the rollers 31 and 32.

Figure 16:
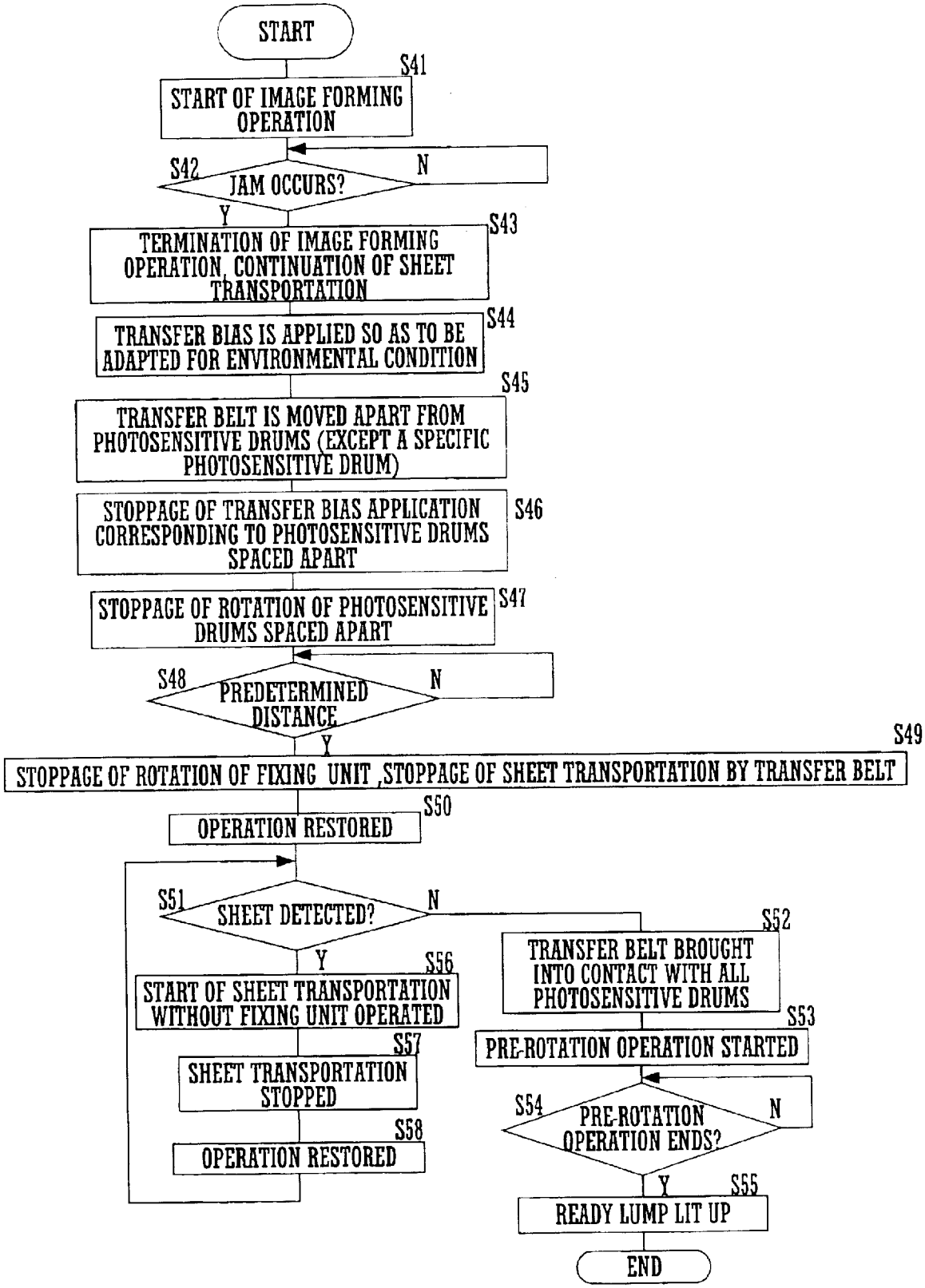
FIG. 16 is a flow chart showing still another example of the jam processing control.

FIG. 16 shows a flowchart of this embodiment.

In a case where a jam is detected after the start of an image forming operation (S41 and S42), at first the image forming operation (a write operation to the photosensitive drums 3 by the exposure units 1, developing operations in the developers and the like), in step S42, is ceased. In this step, in an operation of the fixing unit 12, a current supply to a heater may be ceased, while an rotation operation of the rollers 31 and 32 are continued to cause transportation of a sheet (S43). A transfer bias, in step S44, is set so as to be adapted for an environmental condition and applied to a sheet. In this embodiment as well, a transfer bias is controlled at the first stage so as to be adapted for an environmental condition.

Since in step S43, an image forming operation is ceased during continuous transportation of a sheet, the interior of the image forming apparatus can be made less dirty in jam processing.

The change-over means 38, in step S45, is activated to pivot and move the transfer transport unit 8 and to thereby, move the transfer belt 7 apart from the photosensitive drums 3*b* to 3*d*. This is, as described above, because an attraction force of a sheet to the transfer belt 7 is reduced to the lowest possible level to thereby facilitate the sheet to be peeled off from the transfer belt 7 and because images already formed on the photosensitive drums 3*b* to 3*d* is prevented from to be transferred to the sheet. Application of a transfer bias to the transfer rollers 6*b* to 6*d,* in step 45, is also ceased simultaneously (S46).

An AC high voltage, in this step, may be applied to the transfer rollers 6*b* to 6*d* so as to reduce an attraction force positively. This is to reduce an attraction force of a sheet to the transfer belt 7 in a case where the force is excessively high or the like case.

Then, rotation of the photosensitive drums 3*b* to 3*d* having been moved apart is ceased (S47), a sheet is transported by a predetermined distance (S48) and thereafter, transportation of the sheet with the transfer belt 7 or the like is ceased (S49).

Then, a restoration operation, in step S50, is performed in a similar manner to that described above. The sheet stays unmoved in a state shown in FIG. 8A, in which situation a restoration operation is easily performed by drawing out the fixing unit 12 as shown in FIG. 8B. Stoppage of the sheet in transportation in this situation is controlled by a timer with the sheet detector A as a reference, wherein detection may also be conducted by the sheet detector B or the sheet detector C located in the upstream side of the sheet.

That is, only an image forming operation is ceased at first (the fixing rollers are driving), thereafter an operation of the fixing unit 12 is then ceased after the sheet is detected by the sheet detector B or the sheet detector C, that is after a predetermined time elapses with a detection timing of the sheet detector A as a reference, and when a predetermined time further elapses from the stoppage of the fixing unit 12, transportation of the sheet is perfectly ceased. After perfect stoppage of transportation of the sheet, the fixing unit 12 is drawn out from the body of the image forming apparatus, and the transfer transport unit 8 is moved apart from all the photosensitive drums 3 interlocking with a draw-out operation of the fixing unit 12 to perform a restoration operation (jam processing) (S43 to S50).

Figure 8A:
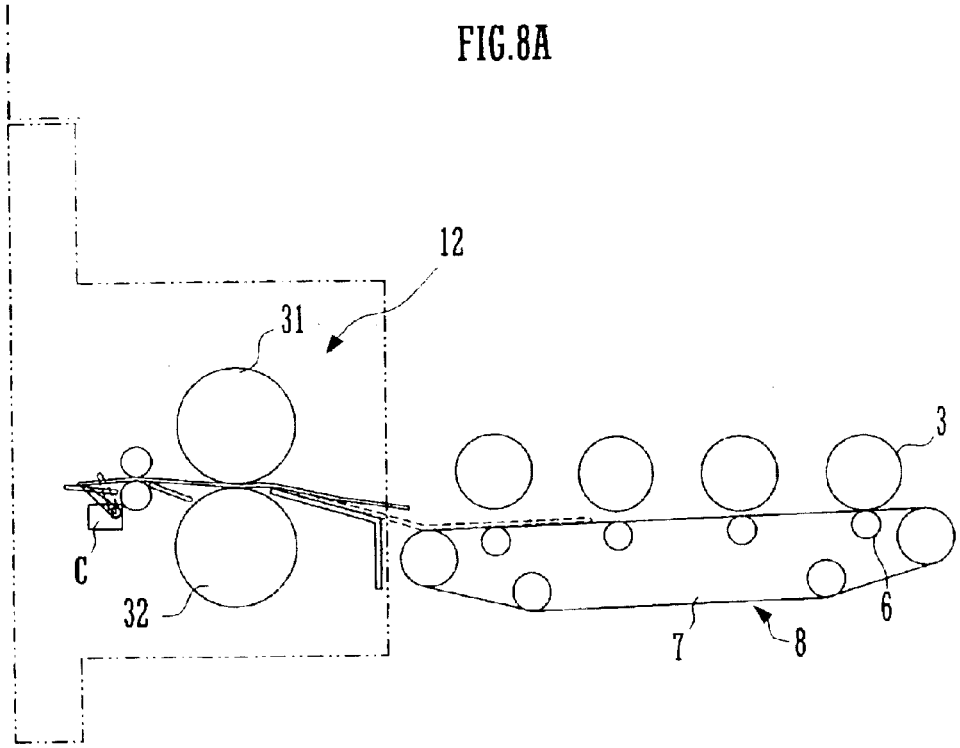
FIGS. 8A and 8B are descriptive views still another example in which a jam processing is performed.
Figure 8B:
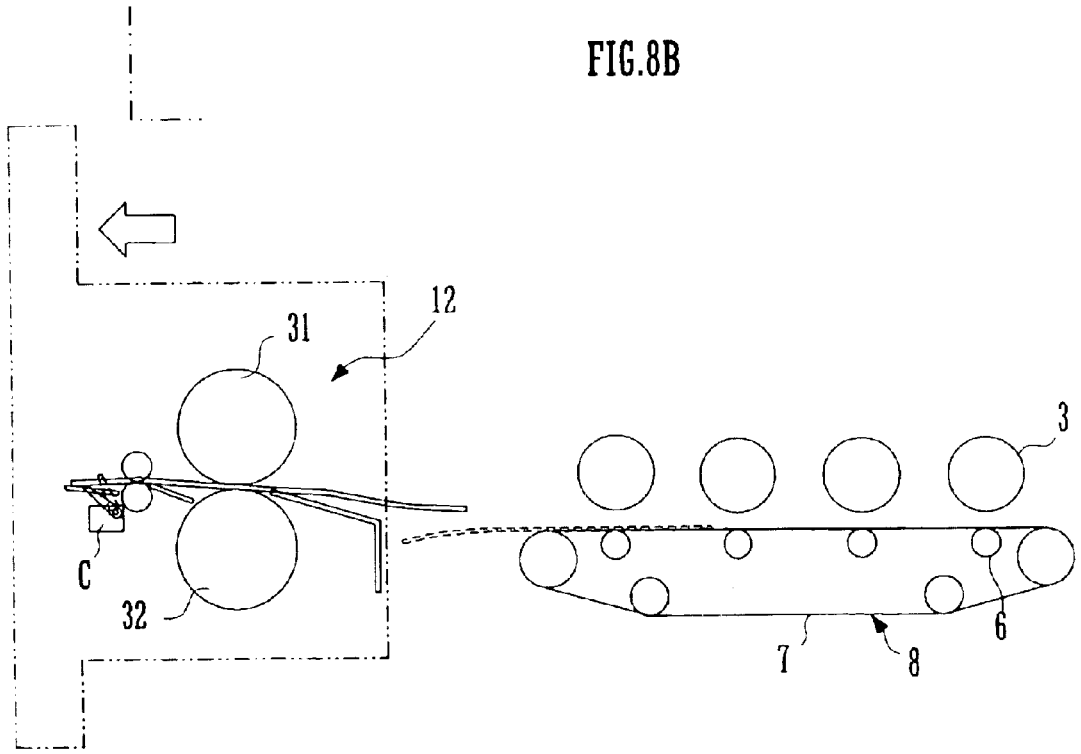

The reason why in the step S48, the sheet is transported by a predetermined distance and thereafter, an operation of the fixing unit 12 is ceased is that a leading sheet is, as shown in FIG. 8A, clenched between the roller members 31 and 32 of the fixing unit 12. In this step, a subsequent sheet (see a broken line) is located at a position before being clenched between the roller members 31 and 32 and by further transporting the subsequent sheet, it can be located at a site where being in contact with the roller members 31 and 32 of the fixing unit 12.

In such a way, the leading sheet is clenched between the roller members 31 and 32, and thereafter, the subsequent sheet is transported to as far as the fixing unit 12, and thereby, the leading and subsequent sheets can be simultaneously taken out after the fixing unit 12 is drawn out, enabling a single jam processing for two sheet in the jam to be realized. The interior of the image forming apparatus is not made dirty by an unfixed toner.

A series of operations in from steps S51 to S58 is of the same contents as a series of operations in from Steps S7 to S14 or from Steps 30 to 37 described above; therefore, description thereof is omitted. A series of operations in from steps S52 to 55 is the same as the above described method; therefore, description thereof is omitted.

Description will be given of still another embodiment.

In this embodiment, an application range (length) of a transfer bias is controlled so as to be adapted for an environmental condition and a transportation control of a sheet similar to that in FIG. 15 is conducted. Thereby, proper transportation of sheets can be conducted as described above with reference to FIG. 20. Leading and subsequent sheets, as shown in FIG. 7, can be simultaneously taken out after the fixing unit 12 is drawn out, thereby enabling a single jam processing for the two sheets in the jam to be realized.

Figure 17:
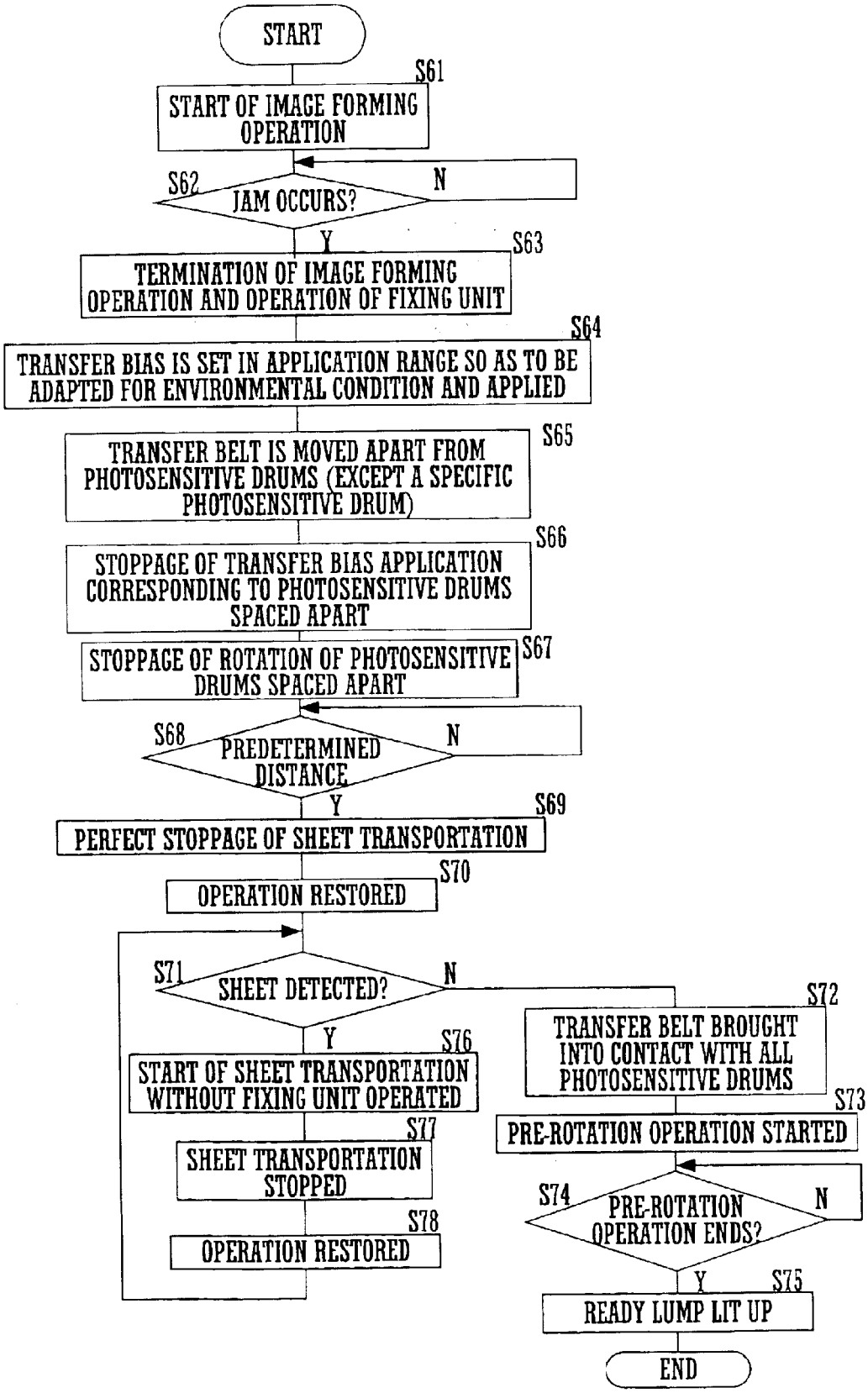
FIG. 17 is a flow chart showing still another example of the jam processing control.

FIG. 17 shows the flowchart of this embodiment. The flow of the whole process is similar to that in FIG. 15. What is different is that in step S64, an application range (length) of a transfer bias is controlled so as to be adapted for an environmental condition.

Description will be given of still another embodiment.

In this embodiment, an application range (length) of a transfer bias is controlled so as to be adapted for an environmental condition and a transportation control of a sheet similar to that in FIG. 16 is conducted. Thereby, a leading sheet, as shown in FIG. 8, can be taken out in a state being clenched between the fixing unit when the fixing unit 12 is drawn out and a subsequent sheet can also be taken out simultaneously, thereby enabling a single jam processing for two sheets in the jam to be realized.

Figure 18:
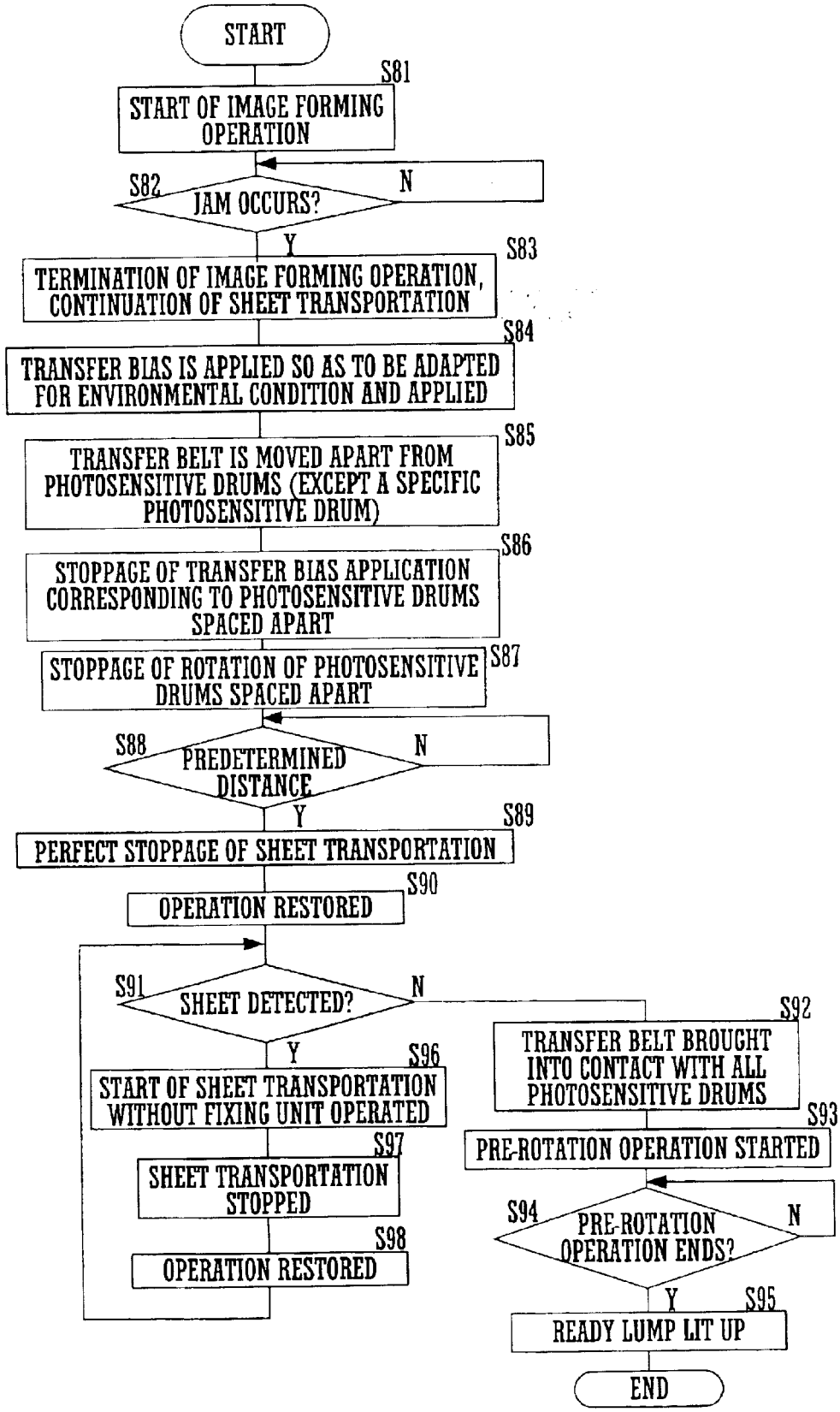
FIG. 18 is a flow chart showing still another example of the jam processing control.

FIG. 18 shows the flowchart of this embodiment. The flow of the whole process is similar to that in FIG. 15. What is different is that in step S84, an application range (length) of a transfer bias is controlled so as to be adapted for an environmental condition.

Description will be given of still another embodiment.

Since a developing agent (a toner) remains on the photosensitive drums 3, in a case where a sheet is transported over a long distance and a great bend occurs in a transport path, an unfixed toner on the bent portion has a high possibility to be attached to members in the peripheral region of the transport path to make them dirty.

Therefore, at the first stage immediately after occurrence of a jam is detected, a sheet in jam can be removed and at the second stage subsequent thereto, the jam processing control section restarts transportation of a sheet and controls a transport length (transport distance) of the sheet in transit so as to be adapted for an environmental condition, that is based on a measurement result of a sensor sensing the environmental condition of a temperature or a humidity in the working atmosphere.

To be concrete, the jam processing control section sets such that a transport length of a sheet recording medium in transit at a higher humidity is shorter than at a lower humidity.

In experiments, investigation is conducted about a relationship of a transport distance of A3 paper with peelability of an firmly attracted paper and dirtiness on the paper by actually altering the transport distance in different environmental conditions (a humidity and a temperature). Results of the experiments are shown in FIG. 21. Note that environmental conditions are in a broad sense divided into two combination of parameters, wherein a combination of an ordinary temperature and an ordinary humidity (25° C. and 50%) is expressed by NN and a combination of a low temperature and a low humidity (5° C. and 30%) is expressed by LL. L is set to 100 mm (see FIG. 4).

As can be seen from FIG. 21, in a case where an environmental condition is NN and if a transport distance (L') is 200 mm (a firmly attracted length 220 mm), peelability, transportability and dirtiness in the peripheral region are all preferable. In a case where an environmental condition is LL and if a transport distance (L') is 250 mm (a firmly attracted length 170 mm), peelability, transportability and dirtiness in the peripheral region are all preferable.

Accordingly, a transport distance (L', see FIG. 4) of a sheet when a jam occurs is set to 200 mm in a case where an environmental condition is a combination of an ordinary temperature and an ordinary humidity (25° C. and 50%) while a transport distance of a sheet when a jam occurs is set to 250 mm in a case where an environmental condition is a combination of a low temperature and a low humidity (5° C. and 30%), in each of which situations a jam processing can be performed with ease without making members in the peripheral region dirty.

Figure 13:
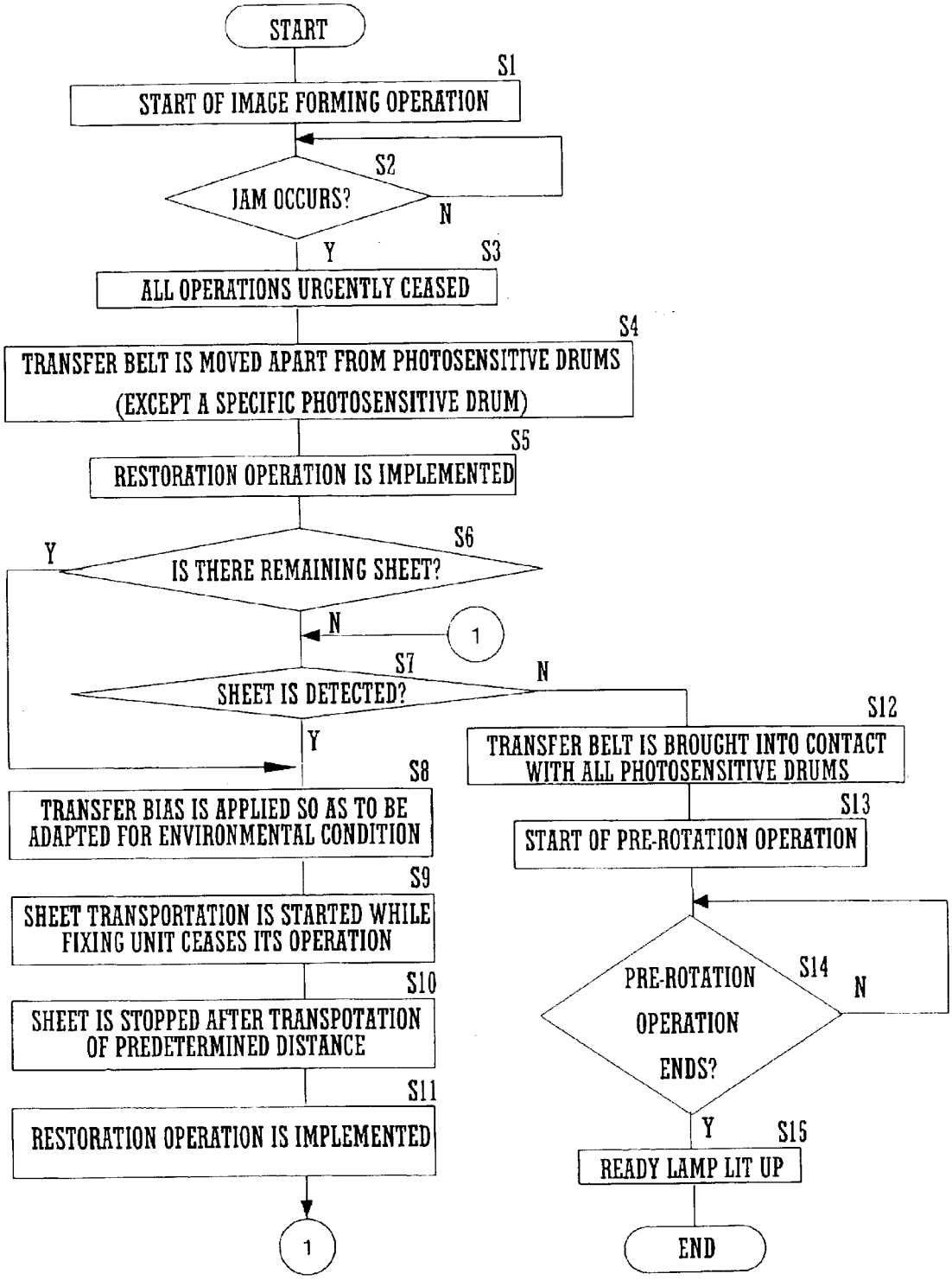
FIG. 13 is a flowchart showing an example of jam processing control.

In this embodiment, a transport distance of a sheet is controlled so as to be adapted for an environmental condition and transportation control of a sheet similar to that in FIG. 13 is conducted.

Figure 22:
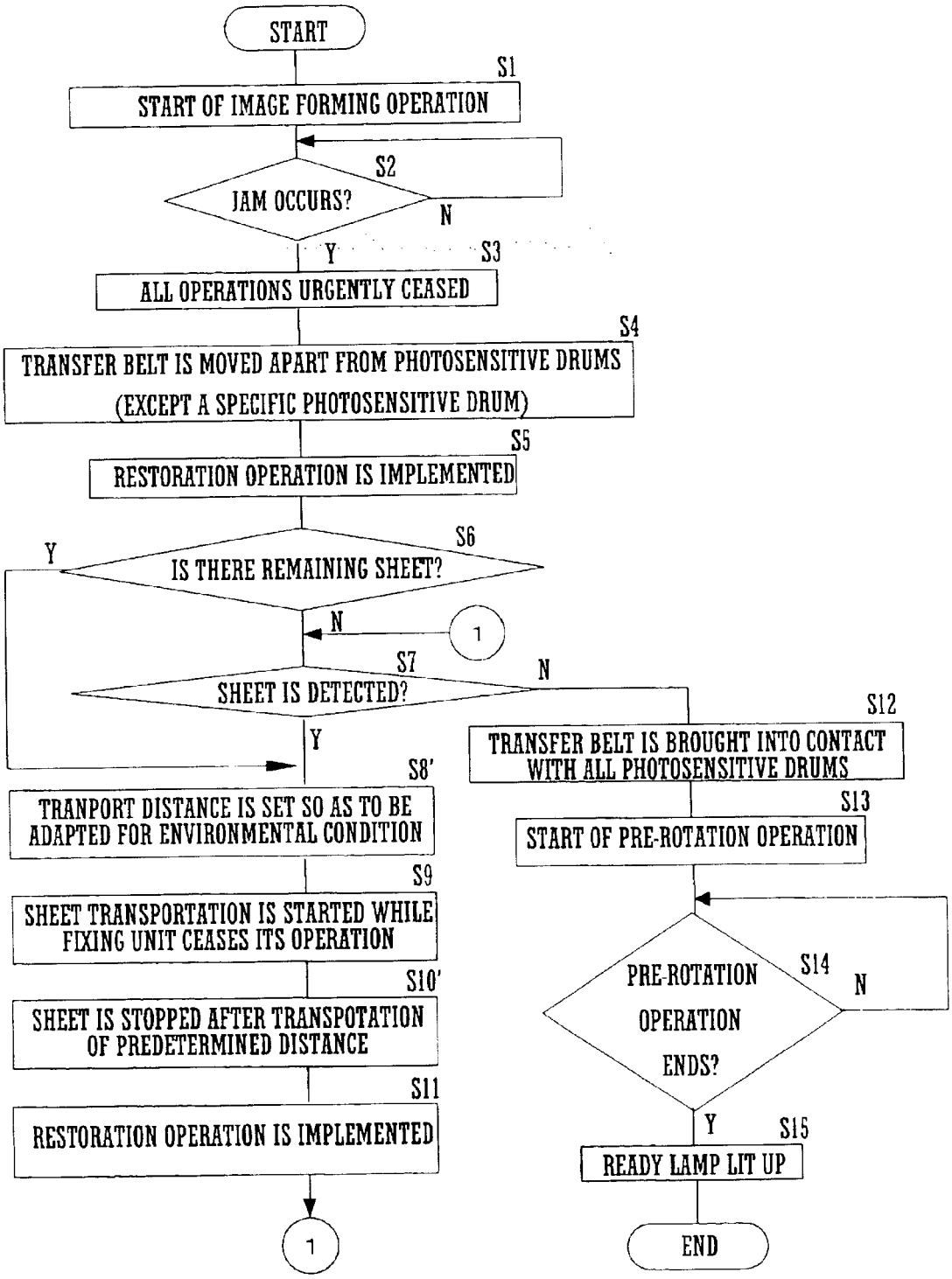
FIG. 22 is a flow chart showing still another example of the jam processing control.

FIG. 22 shows a flowchart of this embodiment. The flowchart is similar to that in FIG. 13. What is different is that in step S8', a transport distance of a sheet is controlled so as to be adapted for an environmental condition and that in step S10', the sheet is transported only by the transport distance controlled as described above.

Description will be given of still another embodiment.

In this embodiment, a transport distance of a sheet is controlled so as to be adapted for an environmental condition and a transportation control of a sheet similar to that in FIG. 14 is performed.

Figure 23:
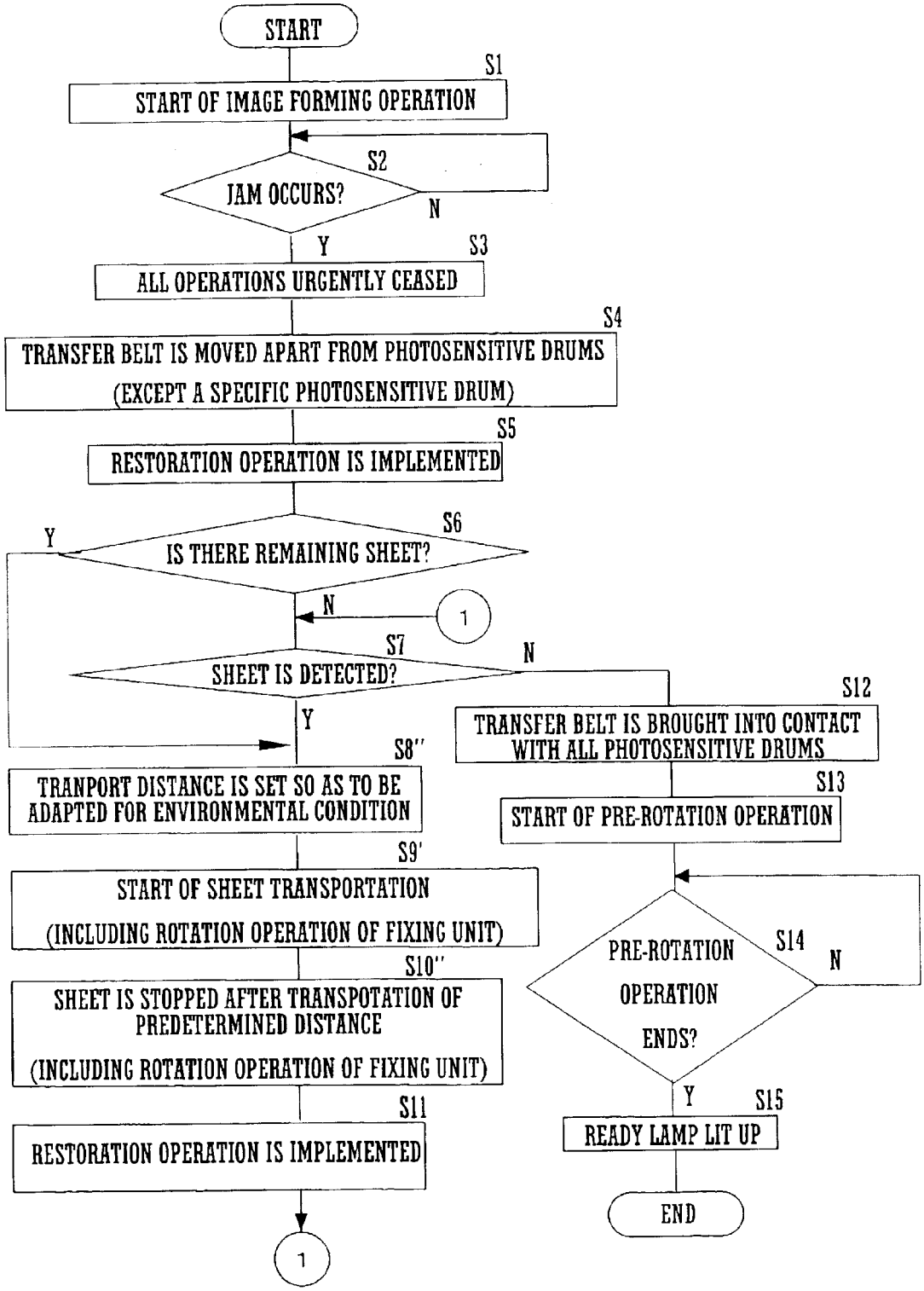
FIG. 23 is a flow chart showing still another example of the jam processing control.

FIG. 23 shows a flowchart of this embodiment. The flowchart is similar to that in FIG. 14. What is different is that in step S8", a transport distance of a sheet is controlled so as to be adapted for an environmental condition and that in step S10", the sheet is transported only by the transport distance controlled as described above.

Description will be given of still another embodiment.

In this embodiment, a transport distance of a sheet is controlled so as to be adapted for an environmental condition and a transportation control of a sheet similar to that in FIG. 15 is performed.

Figure 24:
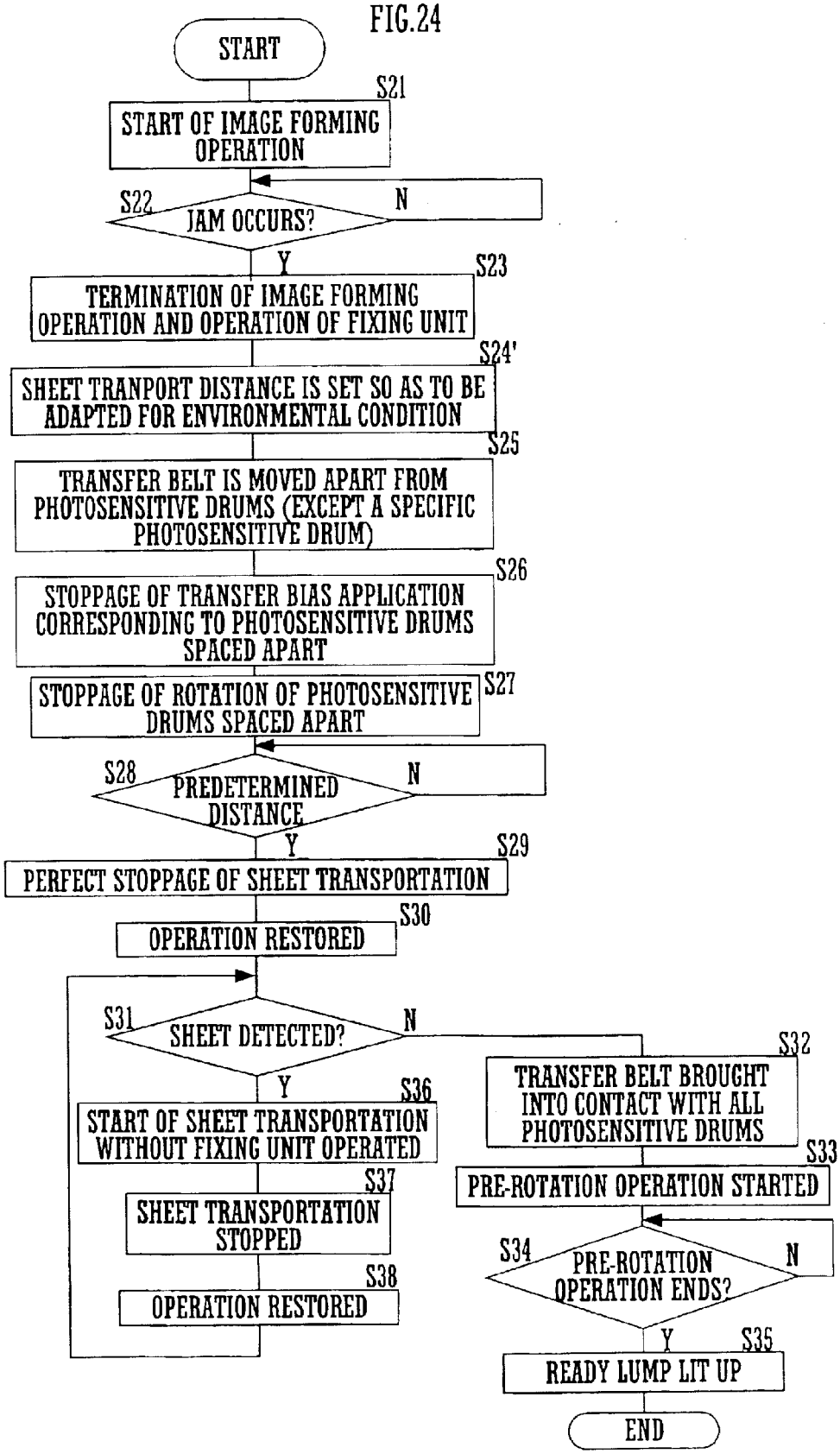
FIG. 24 is a flow chart showing still another example of the jam processing control.

FIG. 24 shows a flowchart of this embodiment. The flowchart is similar to that in FIG. 15. What is different is that in step S24', a transport distance of a sheet is controlled so as to be adapted for an environmental condition.

Description will be given of still another embodiment.

In this embodiment, a transport distance of a sheet is controlled so as to be adapted for an environmental condition and a transportation control of a sheet similar to that in FIG. 16 is performed.

Figure 25:
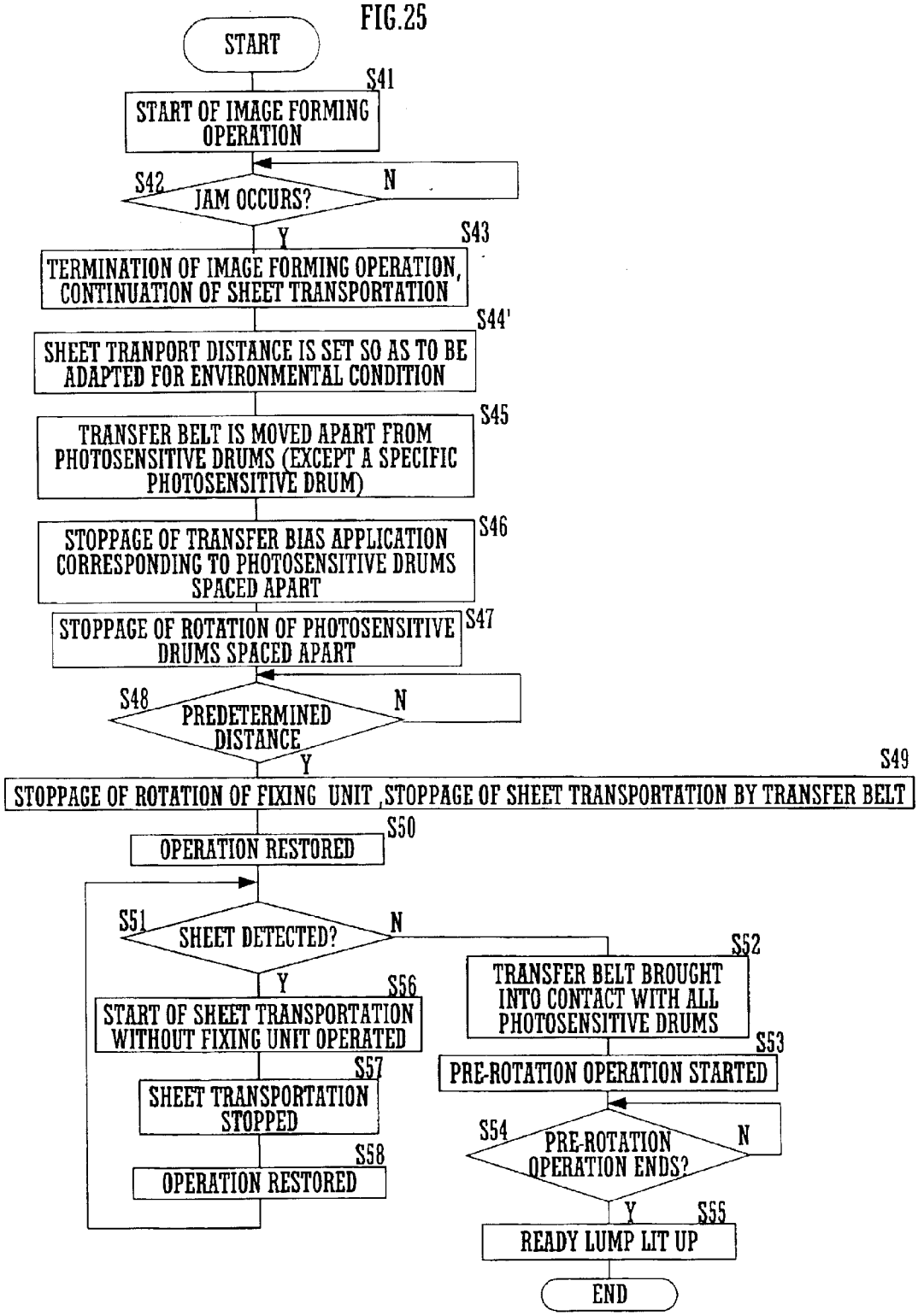
FIG. 25 is a flow chart showing still another example of the jam processing control.

FIG. 25 shows a flowchart of this embodiment. The flowchart is similar to that in FIG. 16. What is different is that in step S44', a transport distance of a sheet is controlled so as to be adapted for an environmental condition.

Description will be given of still another embodiment.

A value of a size of a sheet in transit causes a force necessary to peel off the sheet from the transfer belt 7 to be different. Therefore, if a sheet long in size is controlled to be sufficiently transported at the second stage, a sheet short in size is excessively transported to produce a great bend in a transport path and an unfixed toner on the bend portion is attached to members in the peripheral region of the transport path to cause dirtiness there. If a sheet short in size is sufficiently transported at the second stage, a sheet long in size is insufficiently transported and a possibility arises that all the sheet cannot be peeled off in some case.

Therefore, the jam processing control section, at the second stage, controls a transport length of the sheet based on a size of a sheet in transit.

To be concrete, the jam processing control section sets such that a transport length of a sheet small in size in transit is shorter than a transport length of a sheet large in size in transit.

In the experiments, investigation is performed about peelability of a firmly attracted paper and dirtiness in the apparatus altering a transport distance (L') of the following three kinds of paper different in size from one another with a transport direction as a reference: A3 size (297 mm×420 mm in longitudinal feed), A4 size (297 mm×210 mm in traverse feed) and A4 size (210 mm×297 mm in longitudinal feed). Results of the experiments for sheets in A3 size are shown in FIG. 26.

As is clear from FIG. 26, in a case of A3 size, with a transport distance L' of 100 mm set, though dirtiness in the peripheral region is low, peelability is poor. With a transport distance L' of 200 mm set, peelability and dirtiness in the peripheral region are both at a medium degree. With a transport distance L' of 250 mm set, though peelability is good, dirtiness in the peripheral region is extreme.

In a case of A4 in traverse feed, with transport distances L' of 100 and 150 mm set, peelability and dirtiness in the peripheral region can be both good. In a case of A4 in longitudinal feed, with transport distances L' of 100 and 150 mm set, peelability and dirtiness in the peripheral region can be both good, while with a transport distance L' of 200 mm, though peelability is good, dirtiness in the peripheral region is at a medium degree.

Therefore, according to the results of experiments, a transport distance (L') of a sheet is set, and thereby a jam processing can be performed with a good operability and dirtiness in the apparatus can be suppressed. Note that generally, a transport distance (L') of a sheet when a jam occurs can be said to be preferably larger in a case where a size of a sheet is larger than in a case where a size of a sheet is smaller.

In this embodiment, a transport distance of a sheet is controlled depending on a size of a sheet and a transportation control on a sheet similar to that in FIG. 13 is performed.

Figure 27:
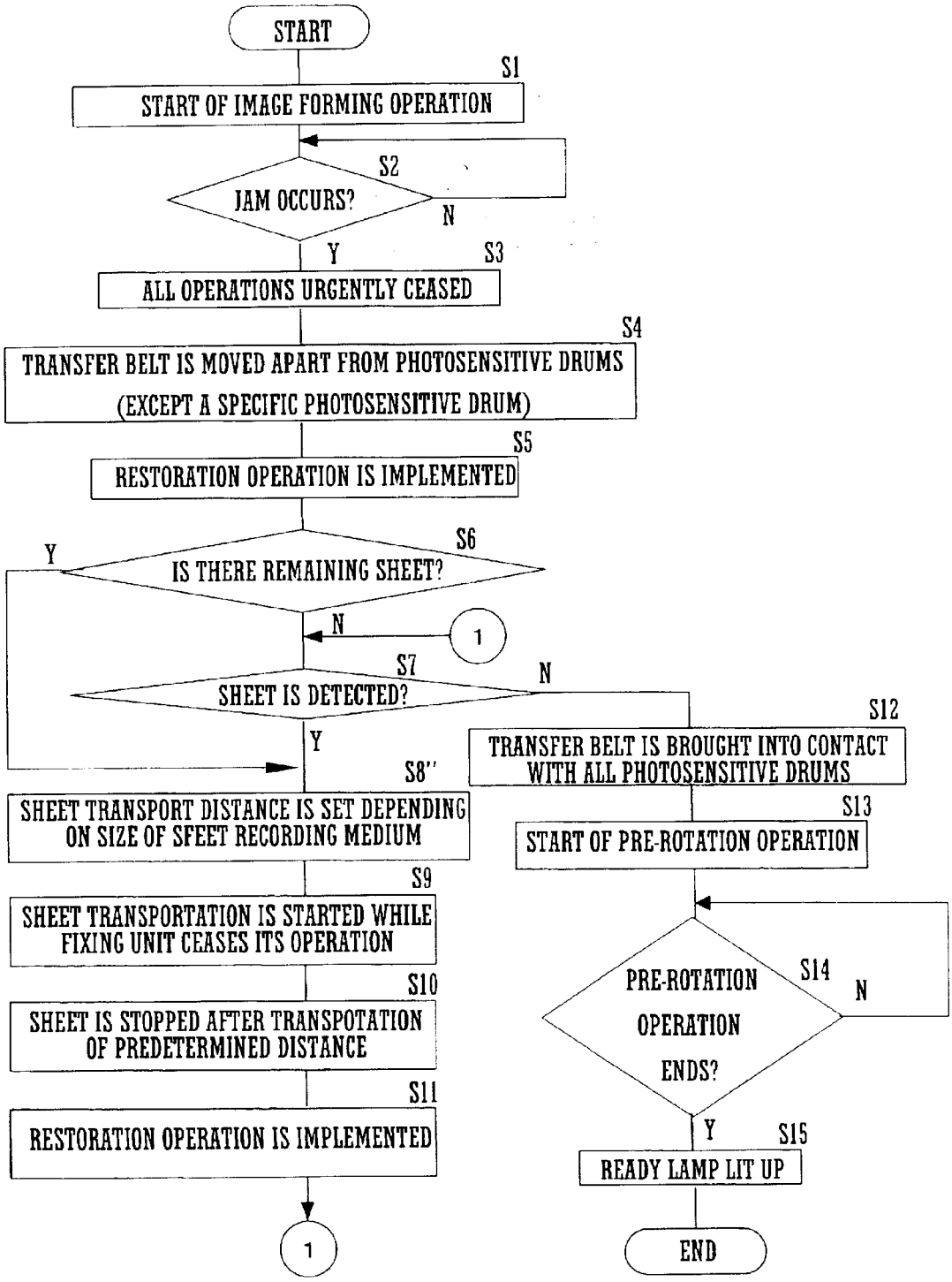
FIG. 27 is a flow chart showing still another example of the jam processing control.

FIG. 27 shows the flowchart of this embodiment. The flowchart is similar to that in FIG. 13. What is different is that in step S8", a transport distance of a sheet is controlled depending on a size of a sheet.

Description will be given of still another embodiment.

In this embodiment, a transport distance of a sheet is controlled depending on a size of a sheet and transportation control on a sheet similar to that in FIG. 14 is performed.

Figure 28:
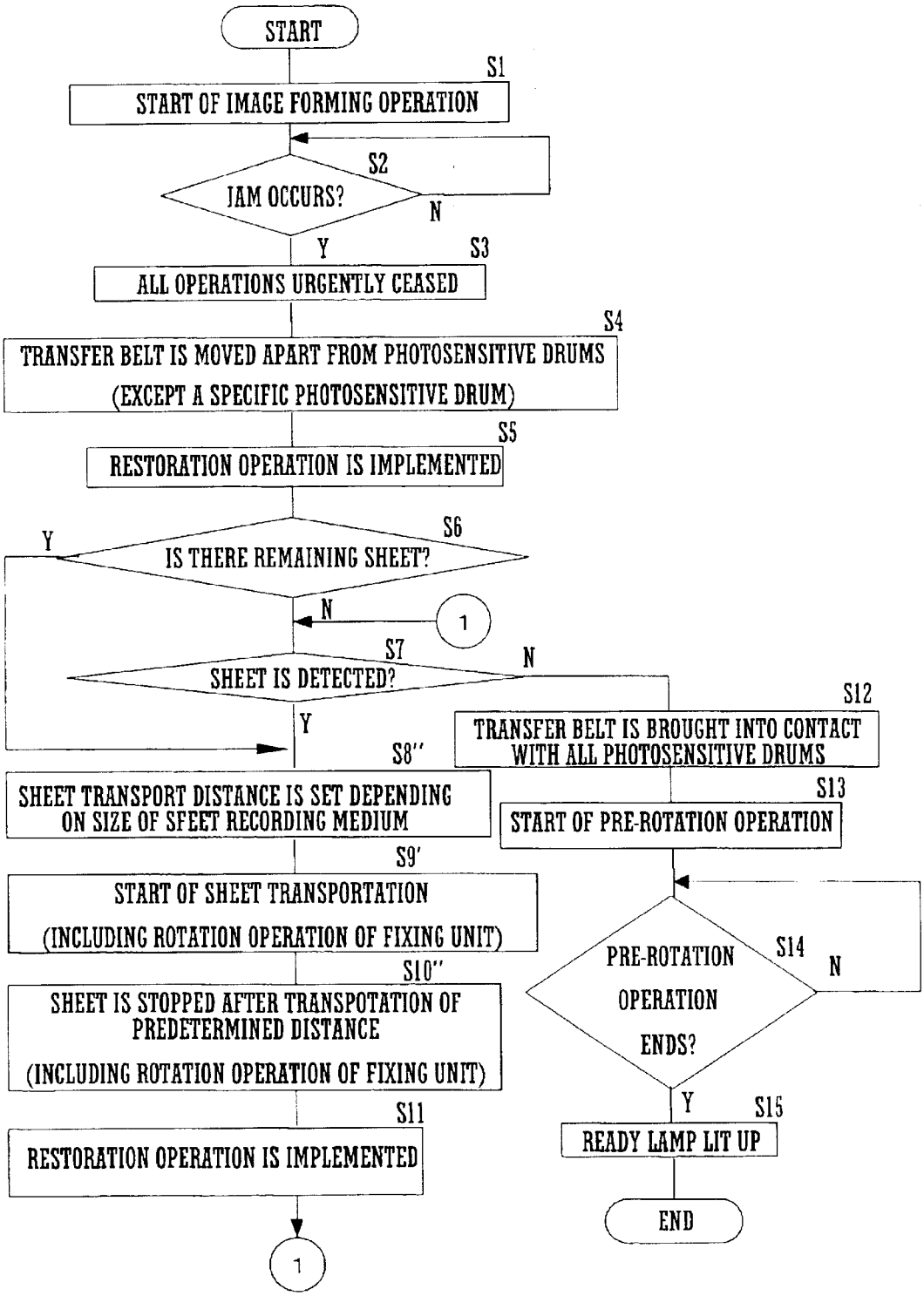
FIG. 28 is a flow chart showing still another example of the jam processing control.

FIG. 28 shows a flowchart of this embodiment. The flowchart is similar to that in FIG. 14. What is different is that in step S8", a transport distance of a sheet is controlled depending on a size of a sheet and that in step S10", the sheet is transported only by a transport distance controlled as described above.

Description will be given of still another embodiment.

In this embodiment, a transport distance of a sheet is controlled depending on a size of a sheet and transportation control on a sheet similar to that in FIG. 15 is performed.

Figure 29:
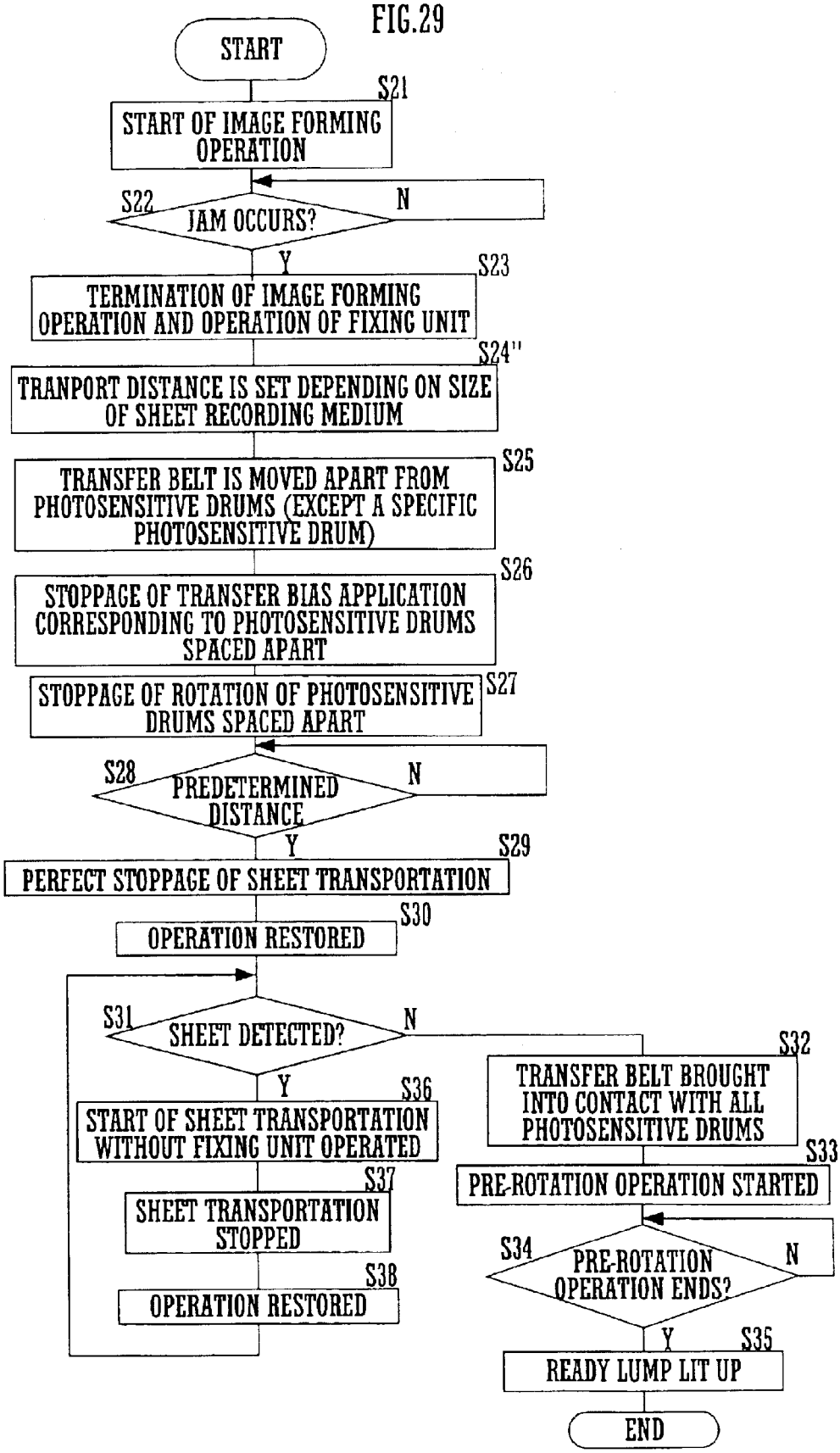
FIG. 29 is a flow chart showing still another example of the jam processing control.

FIG. 29 shows a flowchart of this embodiment. The flowchart is similar to that in FIG. 15. What is different is that in step S24", a transport distance of a sheet is controlled depending on a size of a sheet. In this embodiment, a transport distance of a sheet is controlled depending on a size of the sheet at the first stage.

Description will be given of still another embodiment.

In this embodiment, a transport distance of a sheet is controlled depending on a size of a sheet and transportation control on a sheet similar to that in FIG. 16 is performed.

Figure 30:
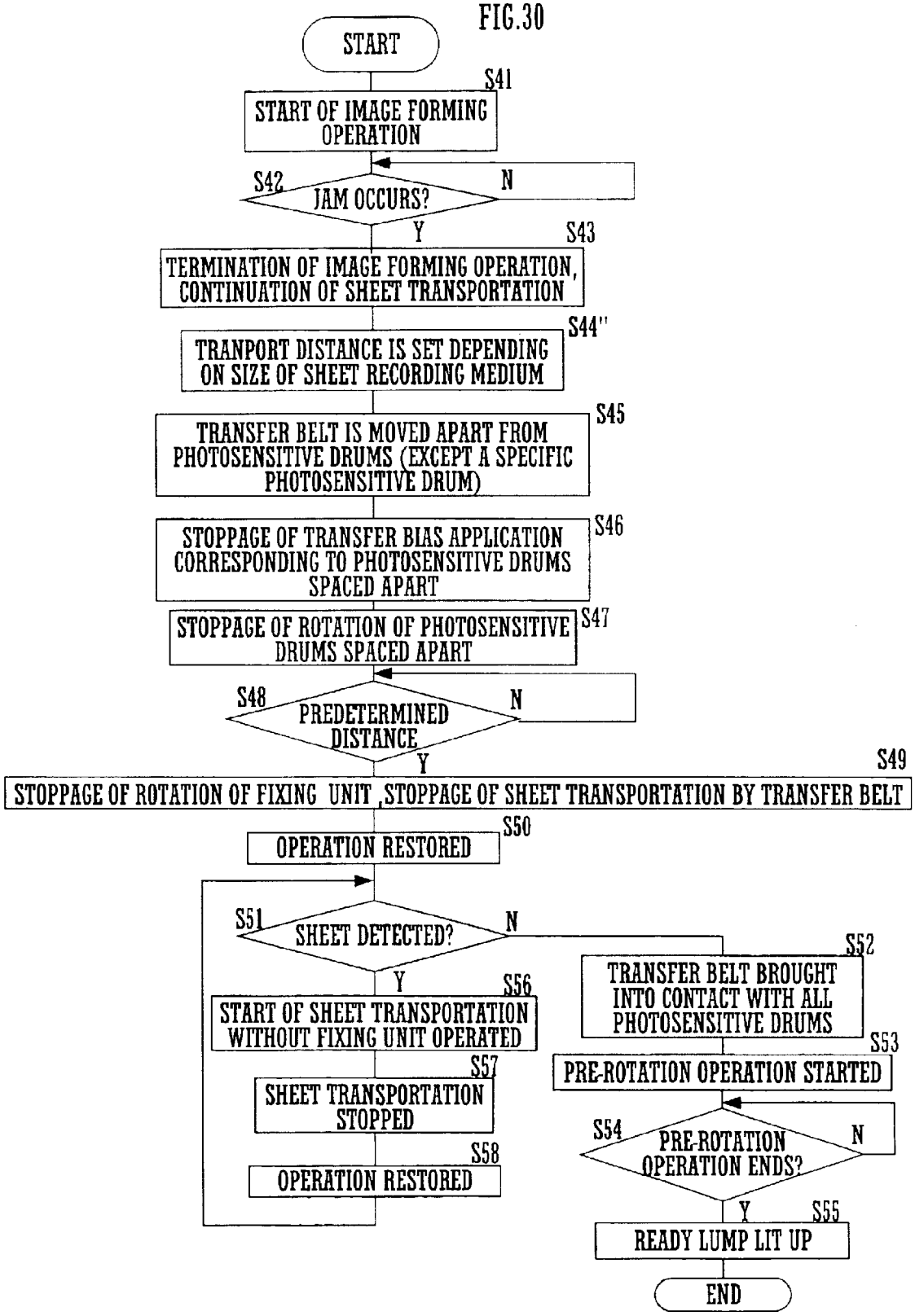
FIG. 30 is a flow chart showing still another example of the jam processing control.

FIG. 30 shows a flowchart of this embodiment. The flowchart is similar to that in FIG. 16. What is different is that in step S44", a transport distance of a sheet is controlled depending on a size of a sheet. In this embodiment, a transport distance of a sheet is controlled depending on a size of the sheet at the first stage.

As described above, in the present invention, in a jam processing, not only is a sheet transported in a transport direction to as far as a site where the sheet is taken out with ease, but control on a transfer bias so as to be adapted for an environmental condition or control on an application range (length) of a transfer bias is also performed, thereby enabling a jam processing to be performed with ease and certainty.

In the present invention, in a jam processing, not only is a sheet transported in a transport direction to as far as a site where the sheet is taken out with ease, but a transport length of the sheet in transit is also controlled so as to be adapted for an environmental condition, thereby enabling a jam processing to be performed with ease and certainty.

In the present invention, in a jam processing, not only is a sheet transported in a transport direction to as far as a site where the sheet is taken out with ease, but a transport length of the sheet is also controlled depending on a size of the sheet in transit, thereby enabling a jam processing to be performed with ease and certainty.

Note that the present invention is not limited to the embodiments described above and alterations thereof in design or improvements thereon are free according to a necessity as far as not departing from the spirit and scope of the present invention.

While in this embodiment, for example, in a case where a jam occurs, the transfer belt 7 is moved apart from the photosensitive drums 3*b* to 3*d* and then a sheet is transported, an attraction force of a sheet to the transfer belt 7 can be controlled to attain a similar effect even in an image forming apparatus in which the sheet is transported without moving the transfer belt 7 apart from the photosensitive drums 3*b* to 3*d* when a jam occurs if an application voltage of a transfer bias to the transfer rollers 6*b* to 6*d* is controlled. In a case where images is already formed on the photosensitive drums 3*b* to 3*d,* the images are transferred to the sheet; therefore, it is preferred that the transfer belt 7 is moved apart from the photosensitive drums 3*b* to 3*d* after a jam occurs and then the sheet is transported.

The image forming apparatus is not limited to the configuration shown in FIGS. 1 and 2. An image forming apparatus to which the present invention is applied includes all configurations in each of which toner images formed on photosensitive drums are transferred onto a sheet transported on the transfer belt and firmly attracted thereto, not only is the toner image fixed to the sheet in the fixing device, but occurrence of the sheet in a jam is also detected by the jam processing control section to cease transportation of the sheet when a jam is detected.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image forming apparatus comprising:

a plurality of image carriers for carrying toner images, thereon, formed by an image forming process in operation thereof, said plurality of image carriers being disposed along a sheet transport direction;

a transfer carrier for transporting a sheet recording medium attracting said sheet recording media thereon to transfer said toner images carried on said plurality of image carriers onto said sheet recording medium;

a transfer voltage applying section for applying a transfer voltage to said sheet recording medium transported by said transfer carrier;

a fixing device for fixing a toner image on said sheet recording medium transported by said transfer carrier, the fixing device being installed so as to be capable of moving toward outside of a side surface of the body of said image forming apparatus;

a jam processing control section for detecting occurrence of a jam of said sheet recording medium in operation of said image forming process to process said sheet recording medium in said jam; and a sensor for measuring an environmental condition of a temperature or humidity in the working atmosphere thereof, wherein said jam processing control section, when detecting occurrence of said jam, ceases transportation of said sheet recording medium in said jam by said transfer carrier as a first stage to make it possible to remove said sheet recording medium in said jam; and, if a second sheet recording medium in transit when said jam occurs is detected by said transfer carrier, advances to a second stage and restarts transportation of said second sheet recording medium in transit using said transfer carrier to transport said second sheet recording medium to said fixing device and to stop it there, and said transfer voltage applying section, when said jam processing control section is at said second stage, controls a transfer voltage to be applied to said second sheet recording medium based on a measurement result of said sensor when said jam processing control section is at said same second stage.

2. The image forming apparatus according to claim 1, wherein said transfer voltage applying section sets such that said transfer voltage at a higher humidity is lower than at a lower humidity.

3. The image forming apparatus according to claim 1, wherein said transfer voltage applying section sets such that a length of said second sheet recording medium to which said transfer voltage is applied is shorter at a higher humidity than at a lower humidity.

4. The image forming apparatus according to claim 3, wherein said transfer voltage applying section applies said transfer voltage in the tail end portion of said second sheet recording-medium in a transport direction thereof at a low humidity while applying said transfer voltage to all the surface of said second sheet recording medium at a high humidity.

5. The image forming apparatus according to claim 1, wherein when said second sheet recording medium is transported by said jam processing control section to a site in the vicinity of the entrance of said fixing device, said fixing device stops a fixing roller section built therein so that said second sheet recording medium is not clenched in said fixing roller section.

6. The image forming apparatus according to claim 1, wherein when said second sheet recording medium is transported by said jam processing control section to a site in the vicinity of the entrance of said fixing device, said fixing device rotates a fixing roller section built therein so that said second sheet recording medium is clenched in said fixing roller section.

7. The image forming apparatus according to claim 1, further comprising a moving-apart or -close section for moving said transfer carrier apart from second image carriers except a first image carrier located in the most upstream side in a sheet transport direction among said plurality of image carriers, wherein said moving-apart or -close section, at said second stage, moves said transfer carrier apart from said second image carriers.

8. The image forming apparatus according to claim 7, wherein said first image carrier continues to be rotation driven at said second stage, while said second image carriers cease rotation driving thereof at said second stage.

9. The image forming apparatus according to claim 7, wherein said first image carrier carries a toner image in a single color and said second image carriers carry toner images in respective other colors.

10. An image forming apparatus comprising:

a plurality of image carriers for carrying toner images, thereon, formed by an image forming process in operation thereof, said plurality of image carriers being disposed along a sheet transport direction;

a transfer carrier for transporting a sheet recording medium attracting said sheet recording medium thereon to transfer said toner images carried on said plurality of image carriers onto said sheet recording medium;

a transfer voltage applying section for applying a transfer voltage to said sheet recording medium transported by said transfer carrier;

a fixing device for fixing a toner image on said sheet recording medium transported by said transfer carrier, the fixing device being installed so as to be capable of moving toward outside of a side surface of the body of said image forming apparatus;

a jam processing control section for detecting occurrence of a jam on said sheet recording medium in operation of said image forming process to process said sheet recording medium in said jam; and a sensor for measuring an environmental condition of a temperature or humidity in the working atmosphere thereof, wherein said jam processing control section, when detecting occurrence of said jam, ceases transportation of said sheet recording medium in said jam by said transfer carrier as a first stage to make it possible to remove said sheet recording medium in said jam; and, if a second sheet recording medium in transit when said jam occurs is detected by said transfer carrier, advances to a second stage and restarts transportation of said second sheet recording medium in transit using said transfer carrier to transport said second sheet recording medium to said fixing device and to stop it there, and said jam processing control section, when being at the second stage, further controls a transport length of said second sheet recording medium in transit based on a measurement result of said sensor when said jam processing control section is at said same second stage.

11. The image forming apparatus according to claim 10, wherein said jam processing control section sets such that a transfer length of said second sheet recording medium in transit at a higher humidity is shorter than at a lower humidity.

12. The image forming apparatus according to claim 10, wherein when said second sheet recording medium is transported by said jam processing control section to a site in the vicinity of the entrance of said fixing device, said fixing device stops a fixing roller section built therein so that said second sheet recording medium is not clenched in said fixing roller section.

13. The image forming apparatus according to claim 10, wherein when said second sheet recording medium is transported by said jam processing control section to a site in the vicinity of the entrance of said fixing device, said fixing device rotates a fixing roller section built therein so that said second sheet recording medium is clenched in said fixing roller section.

14. The image forming apparatus according to claim 10, further comprising a moving-apart or -close section for moving said transfer carrier apart from second image carriers except a first image carrier located in the most upstream side in a sheet transport direction among said plurality of image carriers, wherein said moving-apart or -close section, at said second stage, moves said transfer carrier apart from said second image carriers.

15. The image forming apparatus according to claim 14, wherein said first image carrier continues to be rotation driven at said second stage, while said second image carriers ceases rotation driving thereof at said second stage.

16. The image forming apparatus according to claim 14, wherein said first image carrier carries a toner image in a single color and said second image carriers carry toner images in respective other colors.

17. An image forming apparatus comprising:

a plurality of image carriers for carrying toner images, thereon, formed by an image forming process in operation thereof, said plurality of image carriers being disposed along a sheet transport direction;

a transfer carrier for transporting a sheet recording medium attracting said sheet recording medium thereon to transfer said toner images carried on said plurality of image carriers onto said sheet recording medium;

a transfer voltage applying section for applying a transfer voltage to said sheet recording medium transported by said transfer carrier;

a fixing device for fixing a toner image on said sheet recording medium transported by said transfer carrier, said fixing device being installed so as to be capable of moving toward outside of a side surface of the body of said image forming apparatus;

a jam processing control section for detecting occurrence of a jam on said sheet recording medium in operation of said image forming process to process said sheet recording medium in said jam; and a sensor for measuring an environmental condition of a temperature or humidity in the working atmosphere thereof, wherein said jam processing control section, when detecting occurrence of said jam, ceases transportation of said sheet recording medium in said jam by said transfer carrier as a first stage to make it possible to remove said sheet recording medium in said jam, and, if a second sheet recording medium in transit when said jam occurs is detected by said transfer carrier, restarts transportation of said second sheet recording medium in transit using said transfer carrier as a second stage to transport said second sheet recording medium to said fixing device and to stop it there, and said jam processing control section, when being is at the second stage, further controls a transport length of said second sheet recording medium based on a size of said sheet recording medium in transit.

18. The image forming apparatus according to claim 17, wherein said jam processing control section sets such that a transfer length of said second sheet recording medium in transit when a size of said second sheet recording medium is smaller is shorter than when a size of said second sheet recording medium is larger.

19. The image forming apparatus according to claim 17, wherein when said second sheet recording medium is transported by said jam processing control section to a site in the vicinity of the entrance of said fixing device, said fixing device stops a fixing roller section built therein so that said second sheet recording medium is not clenched in said fixing roller section.

20. The image forming apparatus according to claim 17, wherein when said second sheet recording medium is transported by said jam processing control section to a site in the vicinity of the entrance of said fixing device, said fixing device rotates a fixing roller section built therein so that said second sheet recording medium is clenched in said fixing roller section.

21. The image forming apparatus according to claim 17, further comprising a moving-apart or -close section for moving said transfer carrier apart from second image carriers except a first image carrier located in the most upstream side in a sheet transport direction among said plurality of image carriers, wherein said moving-apart or -close section, at said second stage, moves said transfer carrier apart from said second image carriers.

22. The image forming apparatus according to claim 21, wherein said first image carrier continues to be rotation driven at said second stage, while said second image carrier ceases rotation driving thereof at said second stage.

23. The image forming apparatus according to claim 17, wherein said first image carrier carries a toner image in a single color and said second image carriers carry toner images in respective other colors.

24. An image forming apparatus comprising:

a plurality of image carriers for carrying toner images, thereon, formed by an image forming process in operation thereof, said plurality of image carriers being disposed along a sheet transport direction;

a transfer carrier for transporting a sheet recording medium attracting said sheet recording medium thereon to transfer said toner images carried on said plurality of image carriers onto the sheet recording medium;

a transfer voltage applying section for applying a transfer voltage to said sheet recording medium transported by said transfer carrier;

a fixing device for fixing a toner image on said sheet recording medium transported by said transfer carrier, said fixing device being installed so as to be capable of moving toward outside of a side surface of the body of said image forming apparatus;

a jam processing control section for detecting occurrence of a jam of said sheet recording medium in operation of said image forming process to process said sheet recording medium in said jam; and a sensor for measuring an environmental condition of a temperature or humidity in the working atmosphere thereof, wherein said jam processing control section, when detecting occurrence of said jam, ceases transportation of said sheet recording medium in said jam by said transfer carrier after said recording medium is transported by said transfer carrier by a predetermined distance as a first stage to make it possible to remove said sheet recording medium in said jam, and, if a second sheet recording medium in transit when said jam occurs is detected by said transfer carrier, advances to a second stage and restarts transportation of said second sheet recording medium in transit using said transfer carrier to transport said second sheet recording medium to said fixing device and to stop it there, and said transfer voltage applying section, when said jam processing control section is at the first stage, controls a transfer voltage to be applied to said sheet recording medium based on a measurement result of said sensor when said jam processing control section is at said same first stage.

25. An image forming apparatus comprising:

a plurality of image carriers for carrying toner images, thereon, formed by an image forming process in operation thereof, said plurality of image carriers being disposed along a sheet transport direction;

a transfer carrier for transporting a sheet recording medium attracting said sheet recording medium thereon to transfer said toner images carried on said plurality of image carriers onto said sheet recording medium;

a transfer voltage applying section for applying a transfer voltage to said sheet recording medium transported by said transfer carrier;

a fixing device for fixing a toner image on said sheet recording medium transported by said transfer carrier, said fixing device being installed so as to be capable of moving toward outside of a side surface of the body of said image forming apparatus;

a jam processing control section for detecting occurrence of a jam of said sheet recording medium in operation of said image forming process to process said sheet recording medium in said jam; and a sensor for measuring an environmental condition of a temperature or humidity in the working atmosphere thereof, wherein said jam processing control section, when detecting occurrence of said jam, ceases transportation of said sheet recording medium in said jam by said transfer carrier after said recording medium is transported by said transfer carrier by a predetermined distance as a first stage to make it possible to remove said sheet recording medium in said jam, and, if a second sheet recording medium in transit when said jam occurs is detected by said transfer carrier, advances to a second stage and restarts transportation of said second sheet recording medium in transit using said transfer carrier to transport said second sheet recording medium to said fixing device and to stop it there, and said transfer voltage applying section, when said jam processing control section is at the first stage, controls said predetermined distance based on a measurement result of said sensor when said jam processing control section is at said same first stage.

26. An image forming apparatus comprising:

a plurality of image carriers for carrying toner images, thereon, formed by an image forming process in operation thereof, said plurality of image carriers being disposed along a sheet transport direction;

a transfer carrier for transporting a sheet recording medium attracting said sheet recording medium thereon to transfer said toner images carried on said plurality of image carriers onto the sheet recording medium;

a transfer voltage applying section for applying a transfer voltage to said sheet recording medium transported by said transfer carrier;

a fixing device for fixing a toner image on said sheet recording medium transported by said transfer carrier, the fixing device being installed so as to be capable of moving toward outside of a side surface of the body of said image forming apparatus;

a jam processing control section for detecting occurrence of a jam of said sheet recording medium in operation of said image forming process to process said sheet recording medium in said jam; and a sensor for measuring an environmental condition of a temperature or humidity in the working atmosphere thereof, wherein said jam processing control section, when detecting occurrence of said jam, ceases transportation of said sheet recording medium in said jam by said transfer carrier after said recording medium is transported by said transfer carrier by a predetermined distance as a first stage to make it possible to remove said sheet recording medium in said jam, and, if a second sheet recording medium in transit when said jam occurs is detected by said transfer carrier, advances to a second stage and restarts transportation of said second sheet recording medium in transit using said transfer carrier to transport said second sheet recording medium to said fixing device and to stop it there, and said transfer voltage applying section, when said jam processing control section is at the first stage, controls a range of said sheet recording medium to which said transfer voltage is applied based on a measurement result of said sensor when said jam processing control section is at said same first stage.

* * * * *